US011874093B2

(12) United States Patent
Clermont et al.

(10) Patent No.: US 11,874,093 B2
(45) Date of Patent: Jan. 16, 2024

(54) BALLISTIC CALCULATOR HUB

(71) Applicant: Sheltered Wings, Inc., Barneveld, WI (US)

(72) Inventors: Todd Clermont, Barneveld, WI (US); Ben Farrell, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 5 days.

(21) Appl. No.: 17/034,833

(22) Filed: Sep. 28, 2020

(65) Prior Publication Data

US 2021/0095938 A1 Apr. 1, 2021

Related U.S. Application Data

(60) Provisional application No. 62/906,235, filed on Sep. 26, 2019.

(51) Int. Cl.
*F41G 3/06* (2006.01)
*F41G 3/08* (2006.01)

(52) U.S. Cl.
CPC ..... *F41G 3/06* (2013.01); *F41G 3/08* (2013.01)

(58) Field of Classification Search
CPC ..... F41G 3/06; F41G 3/08; F41G 3/04; F41G 9/00
USPC ..... 235/414
See application file for complete search history.

(56) References Cited

U.S. PATENT DOCUMENTS

| | | | | |
|---|---|---|---|---|
| 2011/0168777 | A1 | 7/2011 | Bay | |
| 2014/0182187 | A1 | 7/2014 | McHale | |
| 2014/0315156 | A1* | 10/2014 | Averill | F41G 3/08 434/20 |
| 2015/0034722 | A1* | 2/2015 | Roman | F41G 1/467 235/404 |
| 2015/0055119 | A1 | 2/2015 | Hamilton | |
| 2016/0163080 | A1 | 6/2016 | Barker et al. | |
| 2019/0219813 | A1 | 7/2019 | Summerfield et al. | |

OTHER PUBLICATIONS

International Search Report and Written Opinion issued for International Application No. PCT/US20/53075 dated Jan. 4, 2021.

* cited by examiner

*Primary Examiner* — Jamara A Franklin
(74) *Attorney, Agent, or Firm* — Husch Blackwell LLP

(57) ABSTRACT

The disclosure relates to a device for providing a ballistic solution. In one embodiment, the disclosure relates to a device for storing one or more ballistic calculators for providing a ballistic solution. In one embodiment, the device communicates with one or more laser rangefinders.

18 Claims, 16 Drawing Sheets

3. Connected To BH & Phone

1. Connected To Ballistic Hub

2. Connected To Phone

BALLISTIC CALCULATOR HUB

CROSS-REFERENCE TO RELATED APPLICATIONS

This application claims priority to and is a non-provisional application of U.S. Provisional Patent Application No. 62/906,235 filed Sep. 26, 2019, which is incorporated herein in its entirety.

FIELD

In one embodiment, the disclosure relates to a device for providing a ballistic solution. In one embodiment, the disclosure relates to a device for storing one or more ballistic calculators for providing a ballistic solution. In one embodiment, the device communicates with one or more devices including but not limited to a binocular, a monocular, a spotting scope and a laser rangefinder.

BACKGROUND

In competition shooting or western hunting, ballistic calculations/corrections, which are based on the range of the target, environmental conditions, rifle profile, and bullet profile, are critical in making accurate long-range shots. Users would prefer to have the range and ballistic correction available in a way that is real-time and does not require them to take their eyes off the target and out of a viewing optic, such as a riflescope.

Traditional methods of providing range and ballistic correction information in the field involve mobile ballistic applications or manual printed range cards (dope cards). However, traditional methods are not practical in the field. Mobile applications may require a mobile connection to operate and a cellular signal may not be available in remote locations. If a network connection is not present, it would render any Bluetooth connected rangefinders or scopes not useable for ballistic correction data. If utilizing as a standalone mobile application, this still requires the shooter to leave the scope to obtain a ballistic solution. Manually printed range cards can be affixed to the rifle for easy access to range and ballistic correction information. However, these conditions represent a snap shot in time and may be rendered useless if environmental conditions change.

Thus, the need still exists for a device, a system, and a method for providing a ballistic solution to a user in an accurate, timely and efficient manner.

SUMMARY

In one embodiment, the disclosure relates to a device for providing a ballistic solution. In one embodiment, the ballistic solution device communicates with one or more additional external devices. In one embodiment, the ballistic solution device communicates with one or more range finders. In still another embodiment, the device communicates with one or more viewing optics. In one embodiment, the device communicates with one a weather tracking device or a navigation device or a personal wearable device or a smart device or a ballistic solver. In one embodiment, the device communicates through a platform independent of internet and cellular connectivity.

In one embodiment, the device is a ballistic calculator hub that provides a ballistic solution and communicates with one or more devices, including but not limited to a mobile device, a mobile computer, a desktop computer, an iPad, a weather tracker device, a navigation device, a wearable device, a display device, and a ballistic solver. In one embodiment, the ballistic calculator hub further communicates with one or more mobile devices having a mobile application. In one embodiment, the ballistic calculator hub further communicates with one or more laser rangefinders. In yet another embodiment, the ballistic calculator hub further communicates with one or more viewing optics. In one embodiment, the ballistic calculator hub does not use internet or cellular communications to communicate with one or more external devices. In one embodiment, the ballistic hub communicates with the one or more external devices in the absence of internet or cellular connectivity.

In one embodiment, the disclosure relates to a system comprising: a mobile device having a mobile application with a ballistic solver and configured to communicate the ballistic solver to a ballistic hub, the ballistic hub configured to store and operate the ballistic solver and receive a range from a rangefinder, wherein the ballistic hub calculates a ballistic solution using the ballistic solver in the absence of internet or cellular connectivity. In one embodiment, the ballistic hub communicates in through a platform that is independent of internet and cellular connectivity.

In one embodiment, the disclosure relates to a system comprising: a mobile device having a mobile application with a ballistic solver and configured to communicate the ballistic solver to a ballistic hub, the ballistic hub configured to store and operate the ballistic solver and receive a range from a rangefinder, wherein the ballistic hub is not a component of the rangefinder, and the ballistic hub communicates with the rangefinder without internet or cellular connectivity, wherein the ballistic hub calculates a ballistic solution using the ballistic solver in the absence of internet or cellular connectivity.

In one embodiment, the disclosure relates to a device comprising a ballistic hub configured to receive a range from a laser rangefinder and calculate a ballistic solution, wherein the ballistic hub is contained in a fob.

In one embodiment, the fob is compact in size having a height of 3 inches or less, a width of 3 inches or less and depth of 1 inch or less.

In one embodiment, the disclosure relates to a fob comprising a ballistic hub configured to receive a range from a rangefinder and having a ballistic solver to calculate a ballistic solution, wherein the fob has a height of 3 inches or less, a width of 3 inches or less and depth of 1 inch or less.

In one embodiment, the ballistic hub is not a component of a rangefinder. In one embodiment, the ballistic hub is not a component of a viewing optic. In one embodiment, the ballistic hub is not a mobile application. In one embodiment, the ballistic hub is not a component of a weather tracker device.

In one embodiment, the ballistic hub is not incorporated in a rangefinder. In one embodiment, the ballistic hub is not incorporated in a viewing optic. In one embodiment, the ballistic hub is not incorporated into a mobile application of a mobile device. In one embodiment, the ballistic hub is not incorporation into a weather tracker device.

In one embodiment, the ballistic hub is a separate and distinct device from a rangefinder. In one embodiment, the ballistic hub is a separate and distinct device from a viewing optic. In one embodiment, the ballistic hub is a separate and distinct device from a weather tracker device.

In one embodiment, the disclosure relates to a system comprising a range finder and a ballistic hub for providing a ballistic solution. The range finder will send information, including but not limited to range, profiles, wind, etc., to a ballistic hub and/or a mobile phone. In one embodiment, the ballistic hub or mobile phone will provide additional data including but not limited to temperature, pressure, etc. and calculate a ballistic solution based on the provided rangefinder data. The ballistic solutions will be sent back to the rangefinder and be viewable in the rangefinder display along with rangefinder data.

In one embodiment, the disclosure relates to a system comprising a ballistic hub and a mobile device having a mobile application. In one embodiment, the mobile application will be the primary mode for data entry, user setup, and device management and will include the functionality of device Pairing; device settings; selection of firearm settings; selection of bullet settings and libraries; selection of drag models; selection and management of user profiles (saved rifle, bullet and drag model profile); viewing of device environmental sensors and wind bearing capture; compass calibration; single and multiple ballistic display; selection and management of range card profiles; and target parameters.

In one embodiment, the ballistic hub has the functionality of: ballistic solver; temperature; pressure; humidity; user profiles and r range card profiles.

In one embodiment, the mobile device has the functionality of: ballistic solver; temperature; pressure; humidity; user profiles and range card profiles. In one embodiment, the mobile application has the functionality of: ballistic solver; temperature; pressure; humidity; user profiles and r range card profiles.

In one embodiment, the disclosure relates to a system and a method that will allow users to obtain range and ballistic correction information in the field and send this information via a network, including a wireless network, such as Bluetooth, to any connected rangefinder, scope, external device including but not limited to weather tracker device, navigation device and ballistic solver, or electronic personal device including but not limited to a watch, and a small HUD display. As the low energy Bluetooth communication only requires power from small onboard long-life batteries, there is no reliance on external cellular connections, cables or external power.

One advantage of the device, system and method disclosed herein is that a user can use a mobile device having a mobile application to select a ballistic solver of choice to be utilized across all devices and reduce development and licensing costs. Traditionally ballistic solvers are integrated into the firearm accessories, such as a rangefinder, scope, etc. The choice of ballistic solver utilized in these devices is predicated on the suppliers/factory's relationships and alliances with the ballistic solver manufacturer.

In one embodiment, the ballistic hub is compact and can be easily affixed to a key chain, a firearm, or any of the Bluetooth connected firearm devices, including but not limited to a scope, a rangefinder, an external device, and a personal device display device. In one embodiment, the ballistic hub can withstand harsh environmental conditions due to the presence of a waterproof, impact resistant protective case or covering. Firearm profiles and bullet profiles can be preloaded in the ballistic hub via communication with a mobile device having a mobile application.

In one embodiment, the ballistic hub works as a standalone ballistic calculator without the need for connection to external mobile device/mobile applications. In one embodiment, the ballistic hub has integrated environmental sensors that allow the device to capture information including but not limited to environmental information, temperature, pressure and humidity. The ballistic hub only requires blue tooth connection to firearm accessories (scope, rangefinder) and personal display devices, including but not limited to Smart watches, smart phones, smart wrist devices, and if desired, external industry standard environmental meters, including but not limited to a weather tracker device, and a navigation device, to receive the necessary information to calculate a ballistic solution. The ballistic solution along with ranging information can then be sent back to any connected firearm accessory.

In one embodiment, the range and ballistic corrections can then be displayed in the viewing optic eyepiece and rangefinder display. The user receives accurate, real-time range and ballistic correction information without having to take their eyes off the target or out of the scope.

In one embodiment, the disclosure relates to a method comprising: selecting a first ballistic solver using a first mobile application on a mobile device; communicating the selected first ballistic solver from the mobile device to a ballistics hub; using the mobile device to remove the selected first ballistic solver from the ballistic hub; selecting a second ballistic solver using the first or a second mobile application on the mobile device and communicating the selected second ballistic solver from the mobile device to the ballistic hub.

In one embodiment, the method further comprises communicating a range from a rangefinder to the ballistics hub, wherein the ballistic hub uses the range to calculate a ballistic solution.

In another embodiment, the method further comprises using the ballistic hub to calculate a ballistics solution. In another embodiment, the method further comprises using the ballistic hub to calculate a ballistics solution based on range from a rangefinder.

In one embodiment, the method further comprises communicating the ballistic solution from the ballistic hub to a rangefinder and/or a viewing optic and/or a weather tracker device and/or a navigation device and/or an external device and/or a mobile device.

In one embodiment, the disclosure relates to a method comprising communicating a range from a rangefinder to a ballistics hub, calculating a ballistic solution using a ballistic solver of the ballistic hub, and communicating the ballistic solution to the rangefinder and/or a viewing optic and/or a weather tracker device and/or a navigation device and/or an external device and/or a mobile device.

In one embodiment, the ballistic hub and rangefinder communicate through a platform that is independent of internet or cellular connectivity. In one embodiment, the ballistic hub is contained or housed within a fob.

In another embodiment, the method further comprises communicating environmental conditions or parameters from an external device to the ballistic hub.

In another embodiment, the method further comprises communicating geographic conditions or coordinates from a navigation unit to the ballistic hub.

DEFINITIONS

Figure 1:
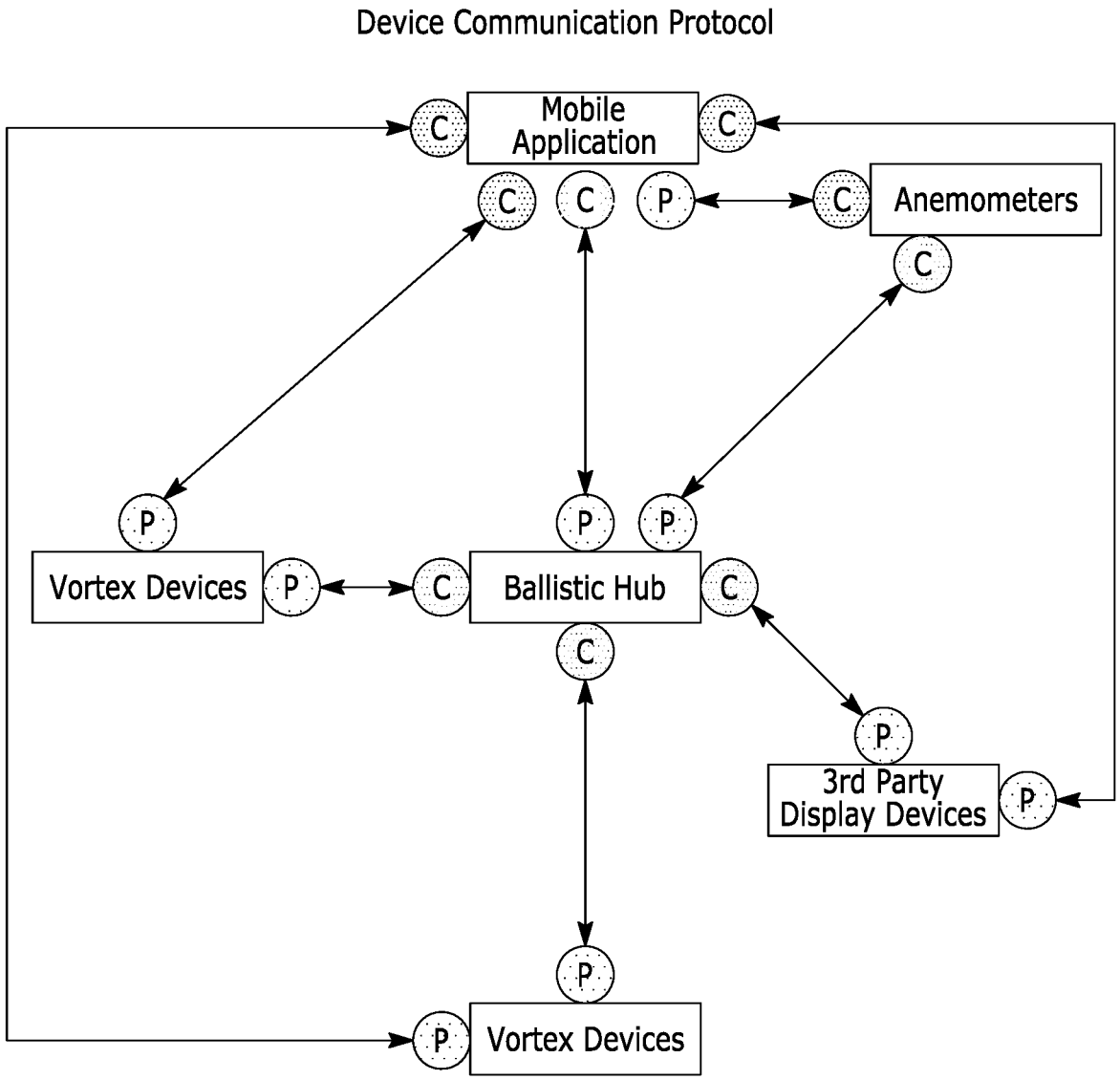
FIG. 1 is a diagram of a representative system disclosed herein depicting a ballistic hub n communication with one or more additional devices.

The apparatuses and methods disclosed herein will now be described more fully hereinafter with reference to the accompanying drawings, in which embodiments of the disclosure are shown. The apparatuses and methods disclosed herein may, however, be embodied in many different forms and should not be construed as limited to the embodiments set forth herein. Rather, these embodiments are provided so that the disclosure will be thorough and complete and will fully convey the scope of the invention to those skilled in the art. All figures and depictions provided herein are representative and non-limiting.

In this description, references to "one embodiment," "an embodiment," or "embodiments," mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

It will be understood that when an element or layer is referred to as being "on," "connected to," or "coupled to" another element or layer, it can be directly on, connected or coupled to the other element or layer. Alternatively, intervening elements or layers may be present. In contrast, when an element is referred to as being "directly on," "directly connected to," or "directly coupled to" another element or layer, there are no intervening elements or layers present.

Like numbers refer to like elements throughout. As used herein, the term "and/or" includes any and all combinations of one or more of the associated listed items.

It will be understood that, although the terms first, second, etc. may be used herein to describe various elements, components, regions, and/or sections, these elements, components, regions, and/or sections should not be limited by these terms. These terms are only used to distinguish one element, component, region, or section from another element, component, region, or section. Thus, a first element, component, region, or section discussed below could be termed a second element, component, region, or section, without departing from the disclosure.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

All patents, patent applications, and non-patent literature references are incorporated herein in their entireties.

The numerical ranges in this disclosure are approximate, and thus may include values outside of the range, unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, viscosity, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure.

The term "and/or" as used in a phrase such as "A and/or B" herein is intended to include both A and B; A or B; A (alone); and B (alone). Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

The terms "comprising," "including," "having" and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term "consisting essentially of" excludes from the scope of any succeeding recitation any other component, step, or procedure, excepting those that are not essential to operability. The term "consisting of" excludes any component, step, or procedure not specifically delineated or listed. The term "or," unless stated otherwise, refers to the listed members individually, as well as in any combination. Use of the singular includes use of the plural and vice versa.

As used herein, a ballistic hub is a common connection point for one or more devices in a network. wherein devices of the network provide information used to calculate or communicate a ballistic solution. In one embodiment, a ballistic hub is a device that can store one or more ballistic calculators to provide a ballistic solution. In one embodiment, the ballistic hub communicates with one or more rangefinders. In another embodiment, the ballistic hub communicates with one or more viewing optics. In one embodiment, the ballistic hub has one or more environmental sensors. In one embodiment, the ballistic hub is configured to communicate with a mobile device having one or more mobile applications. In one embodiment, the ballistic hub is configured to communicate with one or more external devices including but not limited to weather tracker device, a navigation device, a smart device, a wearable device, and a ballistic solver.

As used herein, Bluetooth is an open wireless technology standard for transmitting fixed and mobile electronic device data over short distances. Bluetooth was introduced in 1994 as a wireless substitute for RS-232 cables. Bluetooth 4.0 wireless technology has a range of about 110 yards.

As used herein, a "firearm" is a portable gun, being a barreled weapon that launches one or more projectiles often driven by the action of an explosive force. As used herein, the term "firearm" includes a handgun, a long gun, a rifle, shotgun, a carbine, automatic weapons, semi-automatic weapons, a machine gun, a sub-machine gun, an automatic rifle, and an assault rifle.

As used herein, a "fob" refers to a small, wireless device that can house a ballistic hub. In one embodiment, the fob is air-tight and water-tight. The terms "ballistic fob" and "fob" are used interchangeably.

As used herein, a "target" is a person, an animal, or a place selected as the aim of a projectile. Non-limiting examples of suitable animal targets include game animals such as deer, ducks, turkey, and pheasant.

As used herein, the term "viewing optic" refers to an apparatus used by a shooter or a spotter to select, identify or monitor a target. The "viewing optic" may rely on visual observation of the target, or, for example, on infrared (IR), ultraviolet (UV), radar, thermal, microwave, or magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to the shooter by the "viewing optic" device may be unaltered, or it may be enhanced, for example, by magnification, amplification, subtraction, superimposition, filtration, stabilization, template matching, or other means. The target selected, identified or monitored by the "viewing optic" may be within the line of sight of the shooter, or tangential to the sight of the shooter, or the shooter's line of sight may be obstructed while the target acquisition device presents a focused image of the target to the shooter. The image of the target acquired by the "viewing optic" may be, for example, analog or digital, and shared, stored, archived, or transmitted within a network of one or more shooters and spotters by, for example, video, physical cable or wire, IR, radio wave, cellular connections, laser pulse, optical, 802.11b or other wireless transmission using, for example, protocols such as html, SML, SOAP, X.25, SNA, etc., Bluetooth™, Serial, USB or other suitable image distribution method. The term "viewing optic" is used interchangeably with "optic sight."

As used herein, the term "shooter" applies to either the operator making the shot or an individual observing the shot in collaboration with the operator making the shot.

As used herein, a weather tracker device is any device used to measure one or more environmental conditions. In one embodiment, a weather tracker device can measure or sense altitude (barometric); barometric pressure; compass direction; crosswind; density altitude; dew point temperature; headwind/tailwind; heat stress index; rrelative humidity; station pressure (absolute pressure); temperature; wet bulb temperature (psychrometric); wind chill; and wind speed/air speed.

DETAILED DESCRIPTION

In one embodiment, the disclosure relates to a device, a "ballistic hub," for storing one or more ballistic calculators and providing a ballistic solution. In one embodiment, the ballistic calculator is selected by a user. In one embodiment, a mobile device is used to select and communicate a ballistic solver to a ballistic hub.

In one embodiment, the disclosure relates to a system comprising a mobile device having a mobile application with a ballistic solver and configured to communicate with a ballistic hub and a ballistic hub configured to calculate a ballistic solution. In one embodiment, the disclosure relates to a system comprising a mobile device having a mobile application with a ballistic solver and configured to communicate the ballistic solver to a ballistic hub. A mobile device is used to select a ballistic solver, with the mobile device communicating the selected ballistic solver to the ballistic hub. The ballistic hub now has a user selected ballistic solver to be used with any number of firearms and firearm accessories.

In one embodiment, the ballistic solver stored in the ballistic hub can be changed by accessing the mobile device, and selecting a new ballistic solver. The ballistic hub allows a user to select from a variety of ballistic solvers based on the particular circumstances.

In one embodiment, the ballistic hub can housed in a device that can be easily affixed to a key chain, a firearm, or any connected firearm devices (scope, rangefinder, personal devices, viewing optic) and can withstand harsh environmental conditions due to its waterproof, impact resistant case. As firearm profiles and bullet profiles can be preloaded and stored in the ballistic hub, the ballistic hub works as a standalone ballistic calculator without the need for connection to external mobile applications.

In one embodiment, a fob can store and house the ballistic hub. The fob can be easily affixed to a key chain, a firearm, or any connected firearm devices (scope, rangefinder, personal devices, viewing optic) and can withstand harsh environmental conditions due to its waterproof, impact resistant case. As firearm profiles and bullet profiles can be preloaded and stored in the ballistic hub, the ballistic hub works as a standalone ballistic calculator without the need for connection to external mobile applications.

In one embodiment, the ballistic hub communicates with one or more devices via a wireless network, including but not limited to a Bluetooth network. In one embodiment, the ballistic hub does not use internet to communicate with the one or more external devices. In one embodiment, the ballistic hub does not use cellular connectivity to communicate with the one or more external devices.

In another embodiment, a ballistic hub can have one or more integrated environmental sensors to allow the device to capture information including but not limited to temperature, pressure and humidity.

In one embodiment, the ballistic hub can be connected to firearm accessories (scope, rangefinder, personal devices, viewing optic) via a wireless network, including but not limited to Bluetooth, and if desired, external industry standard environmental meters or devices to receive the necessary information to calculate a ballistic solution. The ballistic solution along with ranging information can then be conveyed to any Bluetooth connected firearm accessory.

In one embodiment, the range and ballistic corrections can then be displayed in the eyepiece of a viewing optic and/or rangefinder display. The user receives accurate, real-time range and ballistic correction information without having to take their eyes off the target or out of the viewing optic.

In one embodiment, the ballistic hub is a standalone device that provides users the ability to select their ballistic solver of choice. The user can load one or more ballistic solvers into the device depending on the user's desires. In one embodiment, the ballistic hub, as a standalone device, will not have the hardware and memory constraints present when incorporated into a firearm accessory device. This will ensure there are no memory or hardware constraints for uploading different ballistic solutions as they vary widely in regard to memory and processing requirements.

In one embodiment, the disclosure relates to a ballistic hub and/or a mobile device having a mobile application that will work in conjunction with a firearm accessory, including but not limited to a mounted rangefinder to calculate and provide ballistic solutions back to the user. In one embodiment, a single mobile application will provide intuitive streamlined device setup and data entry. The ballistic hub can be utilized when the mobile application is not available or an internet or cellular connection cannot be made or maintained.

In one embodiment, the disclosure relates to a fob housing a ballistic hub that will work in conjunction with a firearm accessory, including but not limited to a mounted rangefinder to calculate and provide ballistic solutions back to the user.

In one embodiment, the disclosure relates to a system having a mobile device with a mobile application, a ballistic hub, and a laser rangefinder. In another embodiment, the system further comprises a viewing optic. In still another embodiment, the system further comprises a weather tracker device. In yet another embodiment, the system further comprises a navigation device. In still yet another embodiment, the system further comprises a device having a ballistic solver. In one embodiment, the ballistic hub is housed within a fob.

FIG. 1 is a representative depiction of a ballistic hub as described herein. The ballistic hub is configured to communicate with one or more mobile devices having one or more mobile applications. The ballistic hub can communicate with any number of mobile devices including but not limited to 1, 2, 3, 4, 5, 6, 7, 8, 9, 10, and more than 10 mobile devices.

In one embodiment, the mobile device communicates a ballistic solver to the ballistic hub. The mobile device can be used to load and unload ballistic solvers based on user preferences.

In one embodiment, the ballistic hub is configured to communicate with sporting optics, including sporting optics manufactured by Vortex Optics, including but not limited to binocular, monocular, spotting scope, riflescope. In one embodiment, the ballistic hub can communicate with any number of sporting optics including but not limited to 1, 2, 3, 4, 5, 6, 7, 8, 9, 10, and more than 10 sporting optics devices.

In one embodiment, the ballistic hub is also configured to communicate with weather tracker devices, including but not limited to Kestrel, WeatherFlow. The ballistic hub is also configured to communicate with ballistic solvers, and rangefinders. The ballistic hub is configured to send and receive information to any number of devices, including but not limited to 1, 2, 3, 4, 5, 6, 7, 8, 9, 10, and more than 10 devices.

Figure 2:
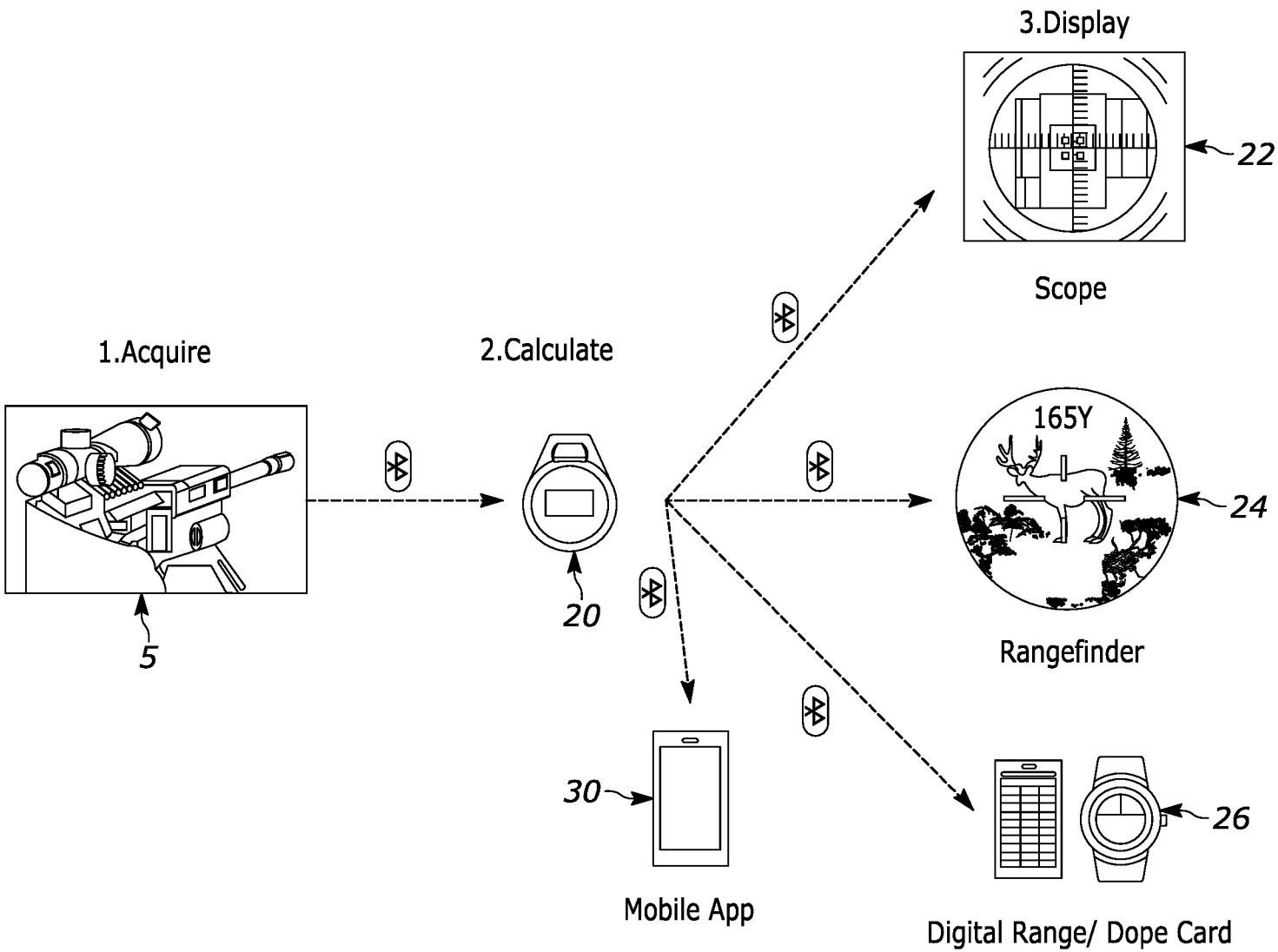
FIG. 2 is a representative system disclosed herein depicting a ranging system used to acquire a distance, a ballistics hub having a user selected ballistic solver for providing a ballistic solution, and options for displaying the ballistic solution.

FIG. 2 is a representative depiction of one non-limiting application of a ballistic hub as described herein. A range is acquired from a laser rangefinder coupled to a firearm 5. The range is communicated to a ballistic hub 20 having a user selected ballistic solver. A mobile application on a mobile device 30 is configured to communicate the ballistic solver to the ballistic hub 20. The ballistic hub computes a ballistic solution using the user selected ballistic solver. The ballistic solution is then communicated to and/or displayed in one or more devices. As depicted in FIG. 2, the ballistic solution can be displayed in the viewing optic 22, a laser rangefinder 24, and/or a digital range card 26, wherein the range card 26 can be displayed on a wearable device or on a DOPE card.

Figure 3A:
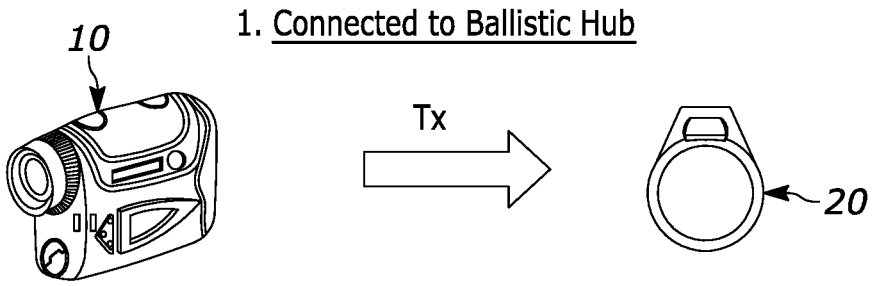
FIG. 3A is a representative depiction of a laser rangefinder configured to communicate with a ballistic hub having a user selected ballistic solver.
Figure 3B:
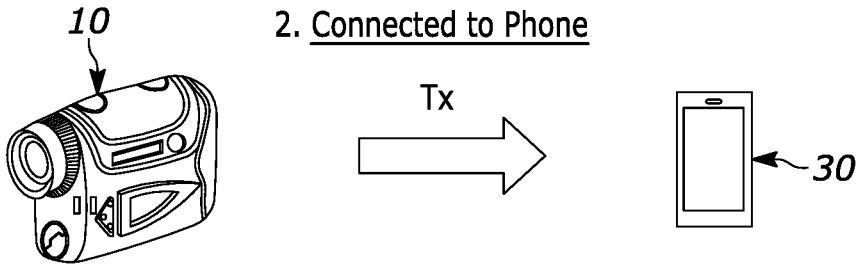
FIG. 3B is a representative depiction of a laser rangefinder configured to communicate with a mobile device having a mobile application with a ballistic solver.
Figure 3C:
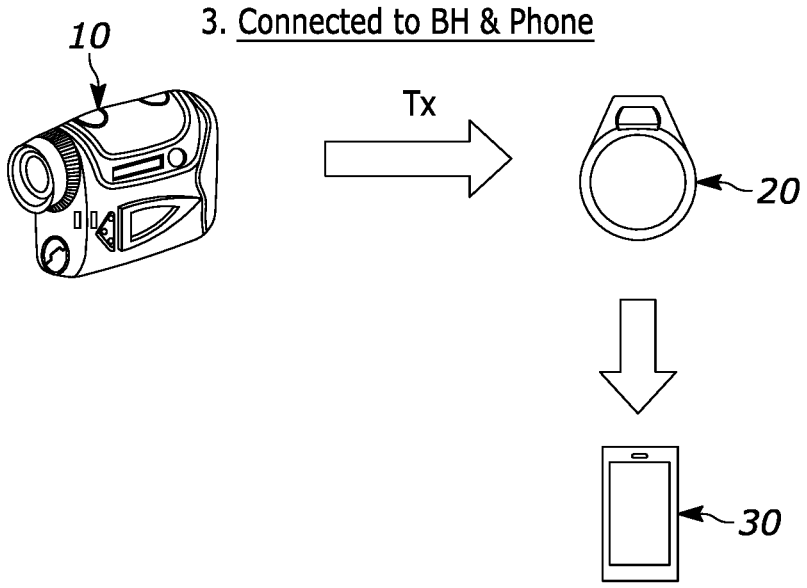
FIG. 3C is a is a representative depiction of a laser rangefinder configured to communicate with a ballistic hub having a user selected ballistic solver, which is configured to communicate with a mobile device having one or more mobile applications.

FIG. 3A is a representative depiction of a laser rangefinder 10 configured to communicate with a ballistic hub 20. FIG. 3B a representative depiction of a laser rangefinder 10 configured to communicate with a mobile device 30. FIG. 3C is a representative depiction of a laser rangefinder 10 configured to communicate with a ballistic hub 20, which is configured to communicate with a mobile device 30. The rangefinder 10 is configured to communicate information to the ballistic hub 20 including but not limited to range distance, user profile, range profile, settings, inclination angle, wind speed, wind direction and target bearing.

Figure 4A:
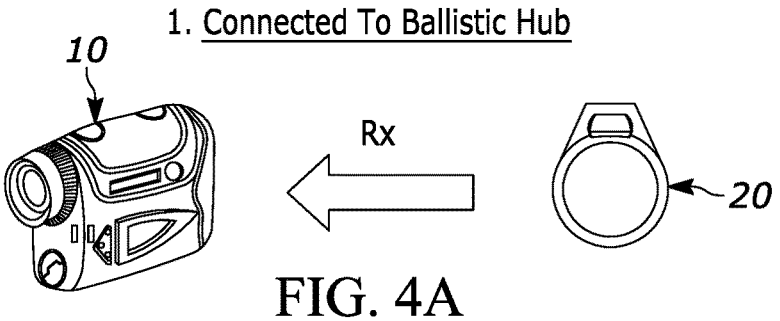
FIG. 4A is a representative depiction of a laser rangefinder configured to receive information from a ballistic hub having a user selected ballistic solver. The ballistic hub is configured to calculate a ballistic solution and communicate the solution to the laser rangefinder.
Figure 4B:
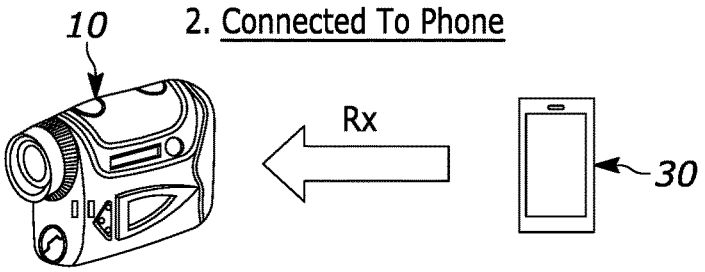
FIG. 4B is a representative depiction of a laser rangefinder configured to receive information from a mobile device having a mobile application having a ballistic solver. The mobile application is configured to calculate a ballistic solution and communicate the solution to the laser rangefinder.
Figure 4C:
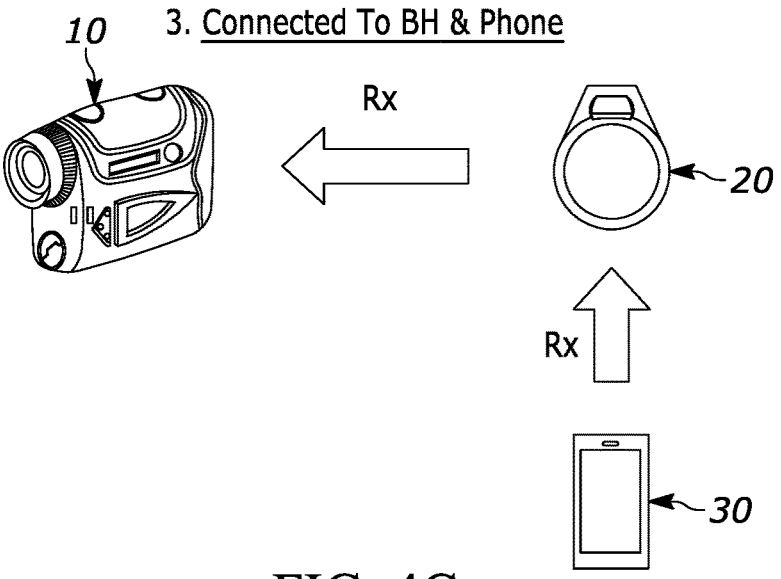
FIG. 4C is a representative depiction of a mobile device configured to communicate information to a ballistic hub, wherein the ballistic hub is configured to communicate a ballistic solution to a laser rangefinder. The ballistic hub and/or the mobile device can be used to calculate a ballistic solution.

FIG. 4A is a representative depiction of a ballistic hub 20 configured to communicate with a laser rangefinder 10. FIG. 4B a representative depiction of a mobile device 30 configured to communicate with a laser rangefinder 10. FIG. 4C is a representative depiction of a mobile device 30 configured to communicate with a ballistic hub 20, which is configured to communicate with a laser rangefinder 10. The ballistic hub 20 and/or mobile device 30 is configured to communicate information to the laser rangefinder 10 including but not limited to a ballistic solution, temperature, wind speed, wind direction, user setting, profiles, pressure, and humidity.

Figure 5A:
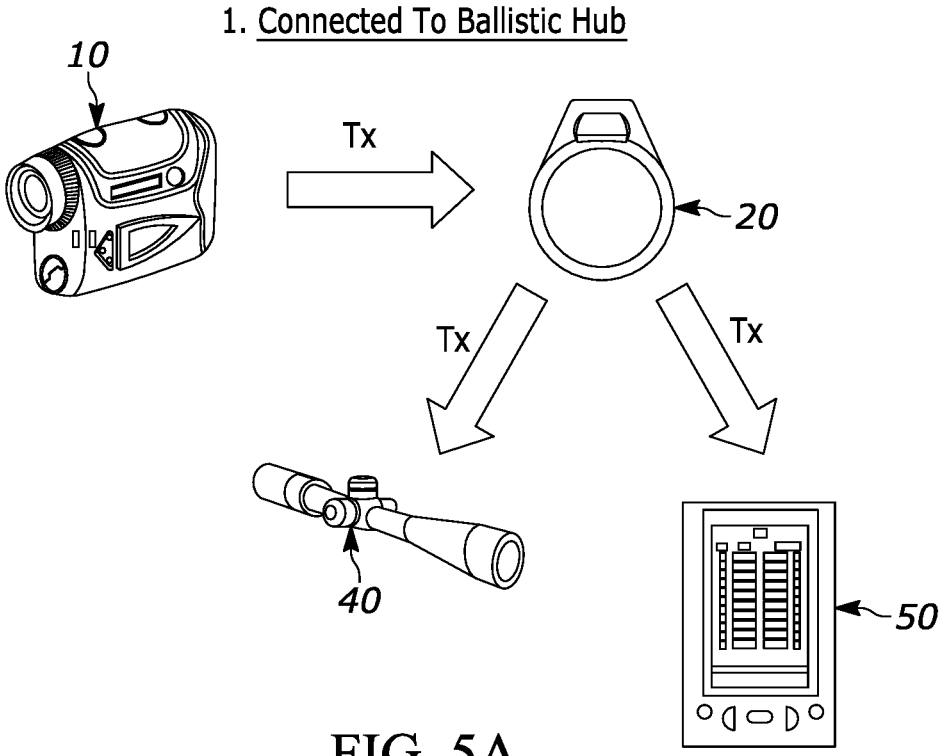
FIG. 5A is a representative depiction of a laser rangefinder configured to communicate with a ballistic hub having a user selected ballistic solver, wherein the ballistic hub calculates a ballistic solution and communicates and displays the solution to a viewing optic and or a remote device.

FIG. 5A is a representative depiction of a laser rangefinder 10 in communication with a ballistic hub 20, wherein the ballistic hub 20 is configured to communicate with one or more viewing optics 40 and/or remote device 50. The rangefinder 10 is configured to communicate information to the ballistic hub 20 including but not limited to range distance, user profile, range profile, settings, inclination angle, wind speed, wind direction and target bearing. The ballistic hub 20 is configured to communicate information to a viewing optic 40 and/or remote device 50 including but not limited to ballistic solution, temperature, pressure and humidity.

Figure 5B:
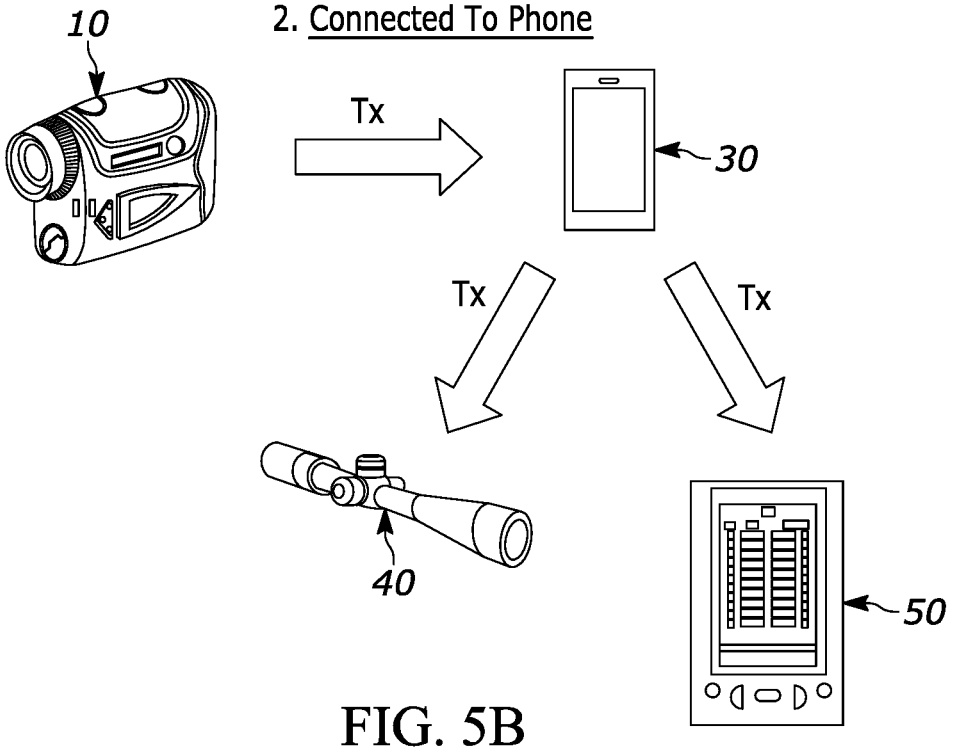
FIG. 5B is a representative depiction of a laser rangefinder configured to communicate with a mobile device having a mobile application with a ballistic solver, wherein the mobile application calculates a ballistic solution and communicates and displays the ballistic solution to a viewing optic and/or a remote device.

FIG. 5B is a representative depiction of a laser rangefinder 10 in communication with a mobile device 30, including but not limited to a mobile phone. The rangefinder 10 is configured to communicate information to the mobile device 30 including but not limited to range distance, user profile, range profile, settings, inclination angle, wind speed, wind direction and target bearing. The mobile device 30 is configured to communicate information, including but not limited to ballistic solution, temperature, pressure and humidity, to a viewing optic 40 and/or an additional device 50

Figure 5C:
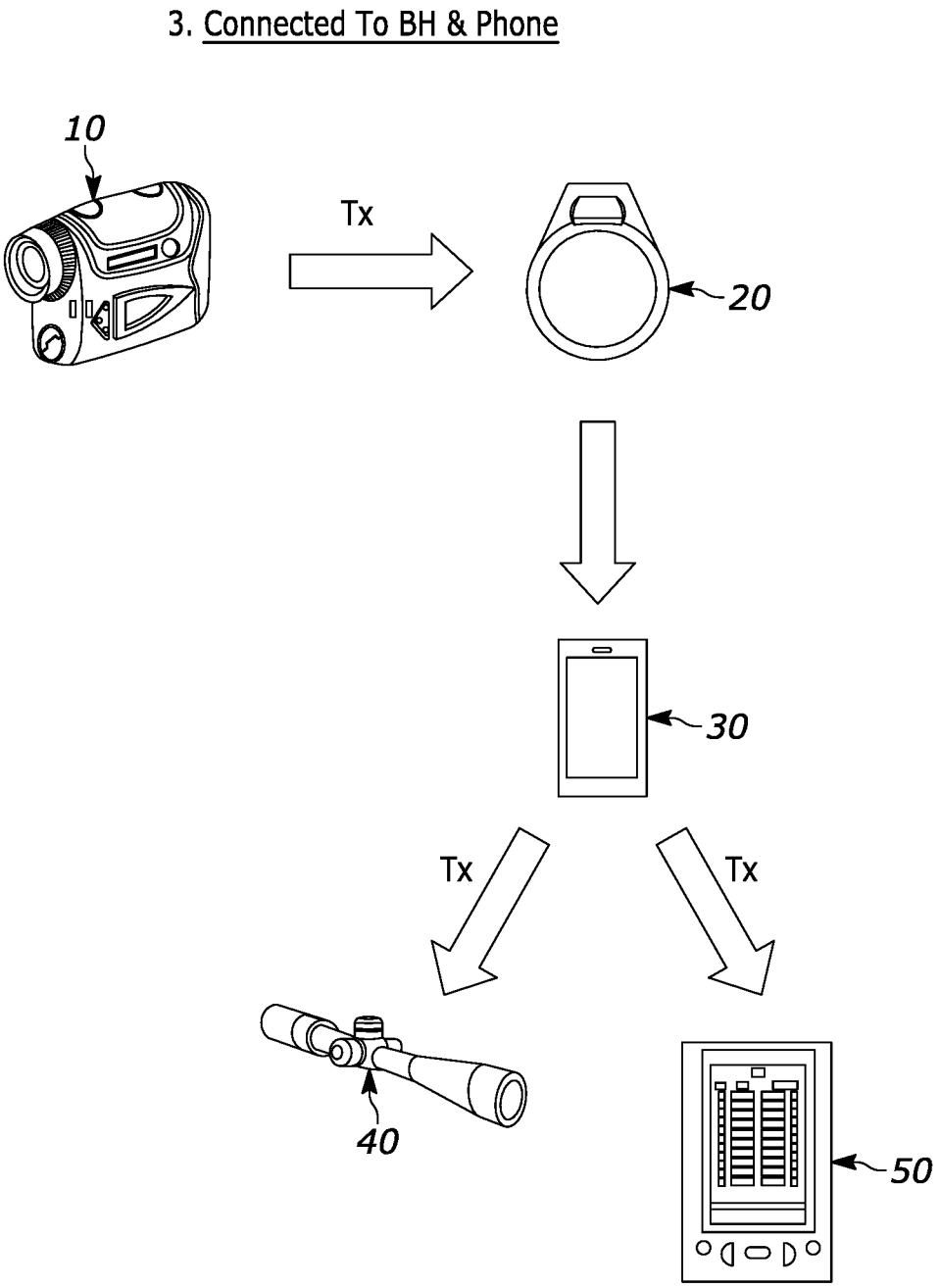
FIG. 5C is a is a representative depiction of a laser rangefinder configured to communicate with a ballistic hub having a user selected ballistic solver, which is configured to communicate with a mobile device having one or more mobile applications, wherein the mobile device communicates and displays a ballistic solution to a viewing optic and/or external device.

FIG. 5C is a representative depiction of a laser rangefinder 10 in communication with a ballistic hub 20, which is in communication with a mobile device 30. The rangefinder 10 is configured to communicate information to the ballistic hub 20 including but not limited to range distance, user profile, range profile, settings, inclination angle, wind speed, wind direction and target bearing. The ballistic hub 20 is configured to communicate information to a mobile device 30 including but not limited to ballistic solution, temperature, pressure and humidity. The mobile device 30 is configured to communicate with a viewing optic 40 and/or a related accessory 50.

Figure 6A:
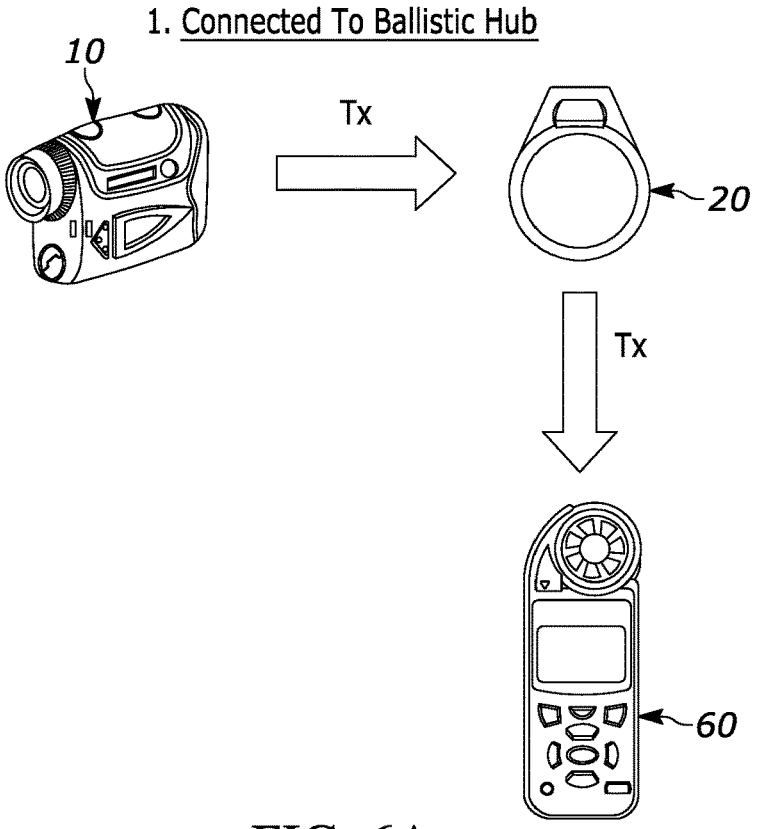
FIG. 6A is a representative depiction of a laser rangefinder configured to communicate with a ballistic hub having a user selected ballistic solver, wherein the ballistic hub is configured to communicate with a weather tracker device, including but not limited to a Kestrel as shown.
Figure 6B:
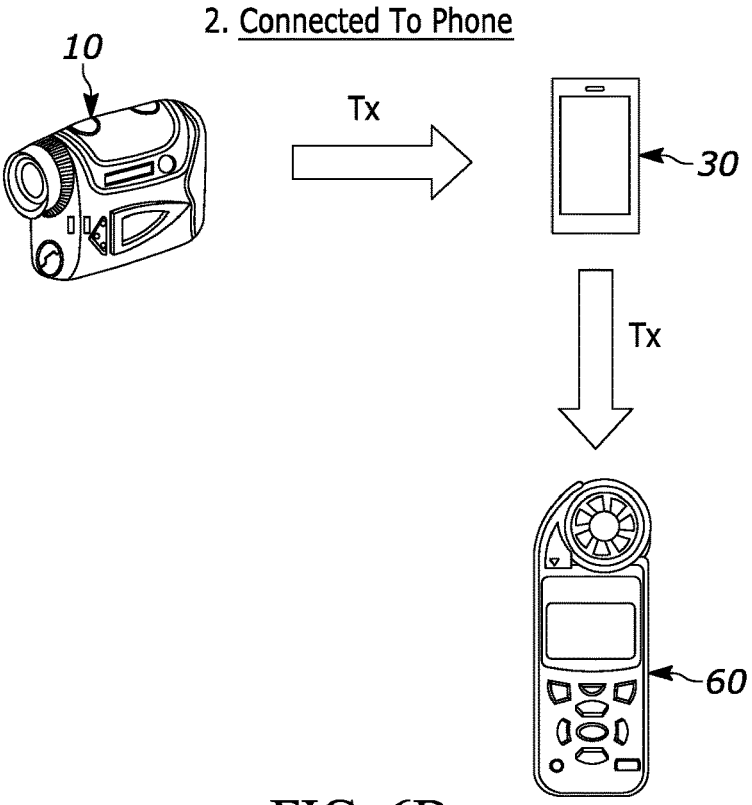
FIG. 6B is a representative depiction of a laser rangefinder configured to communicate with a mobile device having a mobile application with a ballistic solver, wherein the mobile application communicates with a weather tracker device, including but not limited to a Kestrel as shown.
Figure 6C:
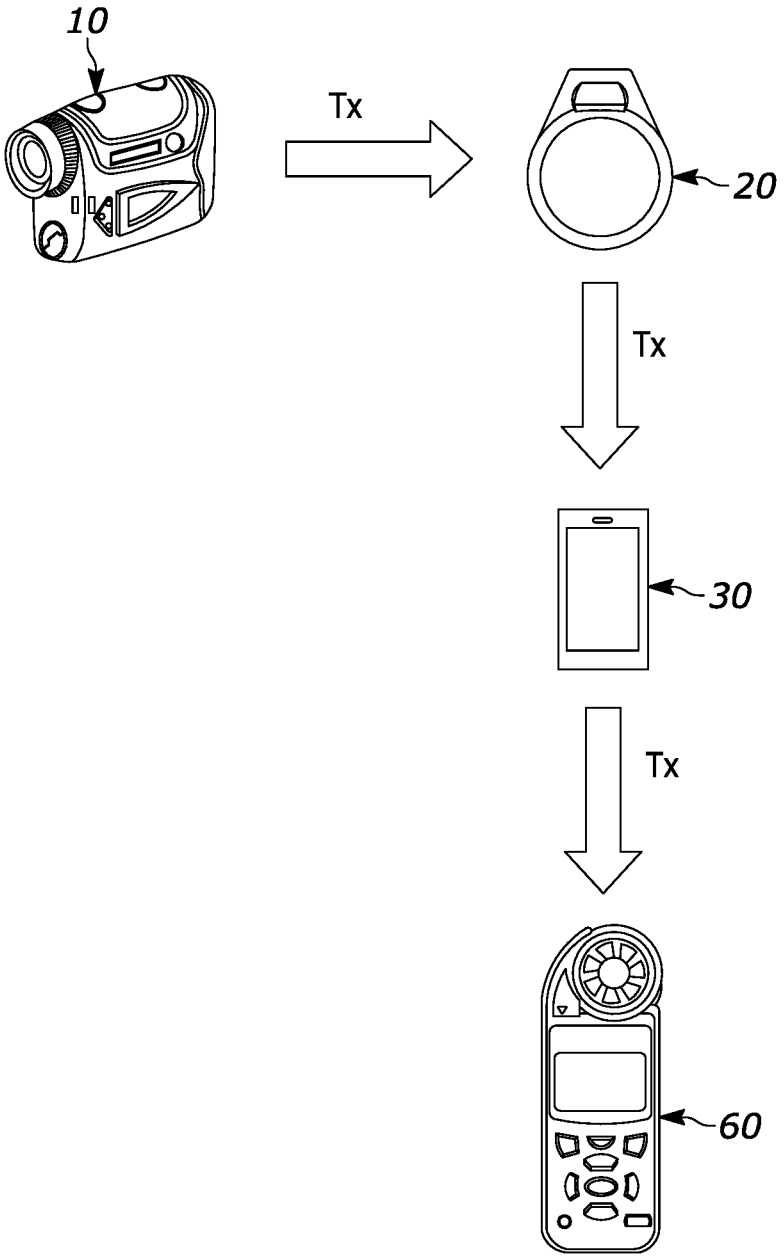
FIG. 6C is a is a representative depiction of a laser rangefinder configured to communicate with a ballistic hub having a user selected ballistic solver, which is configured to communicate with a mobile device having one or more mobile applications, wherein the mobile device communicates with a weather tracker device, including but not limited to a Kestrel as shown.

FIG. 6A is a representative depiction of a laser rangefinder 10 configured to communicate with a ballistic hub 20, which is configured to communicate with a wind and weather tracker 60, such as a Kestrel. FIG. 6B is a representative depiction of a laser rangefinder 10 configured to communicate with a mobile device 30, which is configured to communicate with a wind and weather tracker 60, such as a Kestrel. FIG. 6C is a representative depiction of a laser rangefinder 10 configured to communicate with a ballistic hub 20, which is configured to communicate with a mobile device 30, which is configured to communicate with a wind and weather tracker 60, such as a Kestrel.

In FIGS. 6A-6C, the laser rangefinder 10 is configured to communicate information, including but not limited to range, inclination angle, target bearing, user profile, range profile settings, wind speed, and wind direction, to the ballistic hub 20 and/or mobile device 30. The ballistic hub 20 and/or mobile device 30 is configured to communicate information, including but not limited to range, inclination angle, and target bearing, to the wind and weather tracker device 60. Data may originate from the laser rangefinder 10. Data may originate from the ballistic hub 20 and/or mobile device 30. In one embodiment, all of the data originates from the laser rangefinder 10. In yet another embodiment, all of the data originates from the ballistic hub 20 and/or mobile device 30.

Figure 7A:
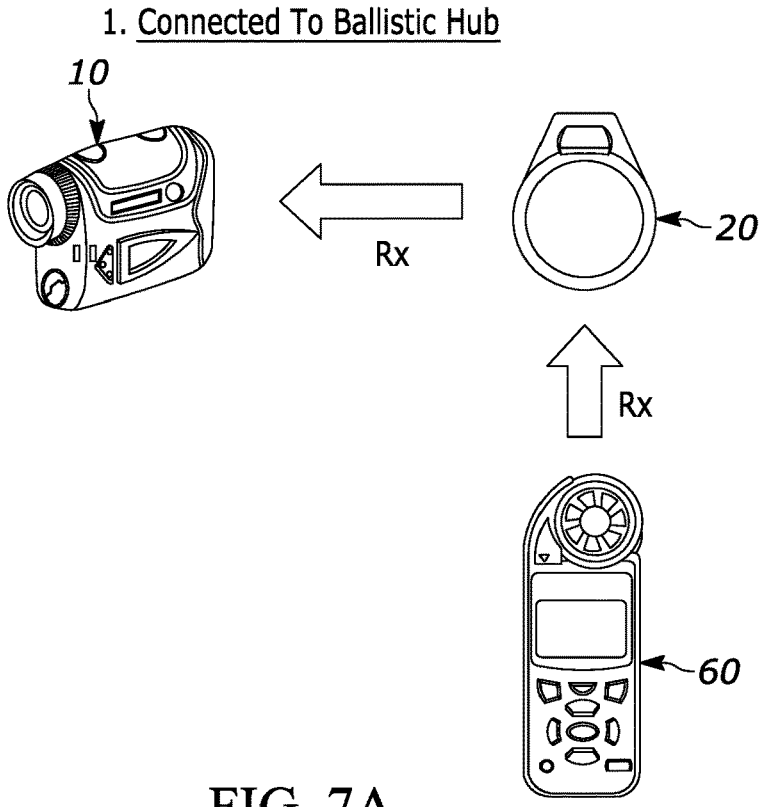
FIG. 7A is a representative depiction of a weather tracker device, such as a kestrel, configured to communicate with a ballistic hub having a user selected ballistic solver to calculate a ballistic solution. The ballistic hub is configured to communicate the ballistic solution to a laser rangefinder.
Figure 7B:
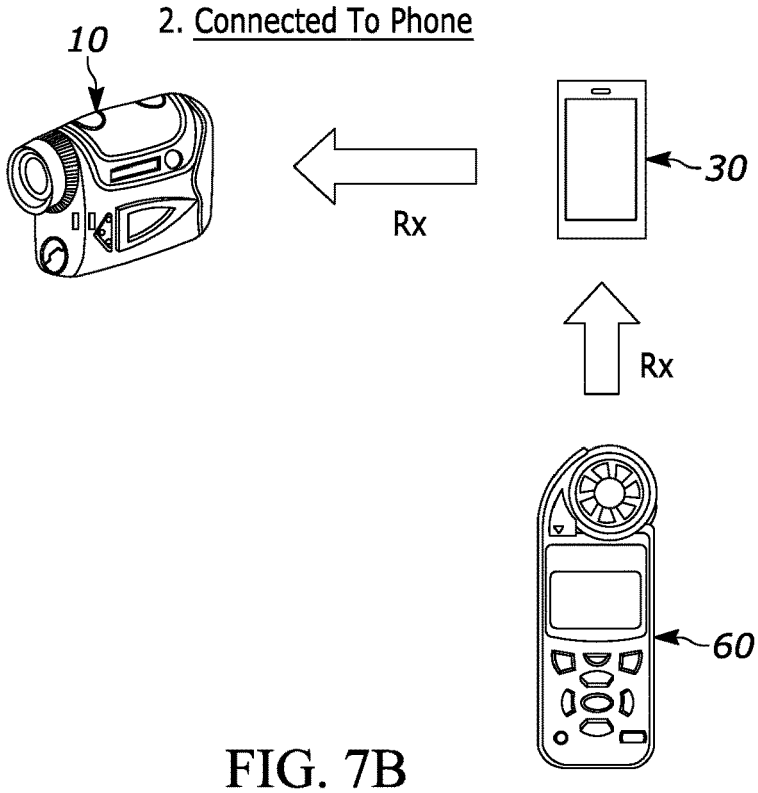
FIG. 7B is a representative depiction of a weather tracker device, such as a kestrel, configured to communicate with a mobile device having a ballistic solver to calculate a ballistic solution. The mobile device is configured to communicate the ballistic solution to a laser rangefinder.
Figure 7C:
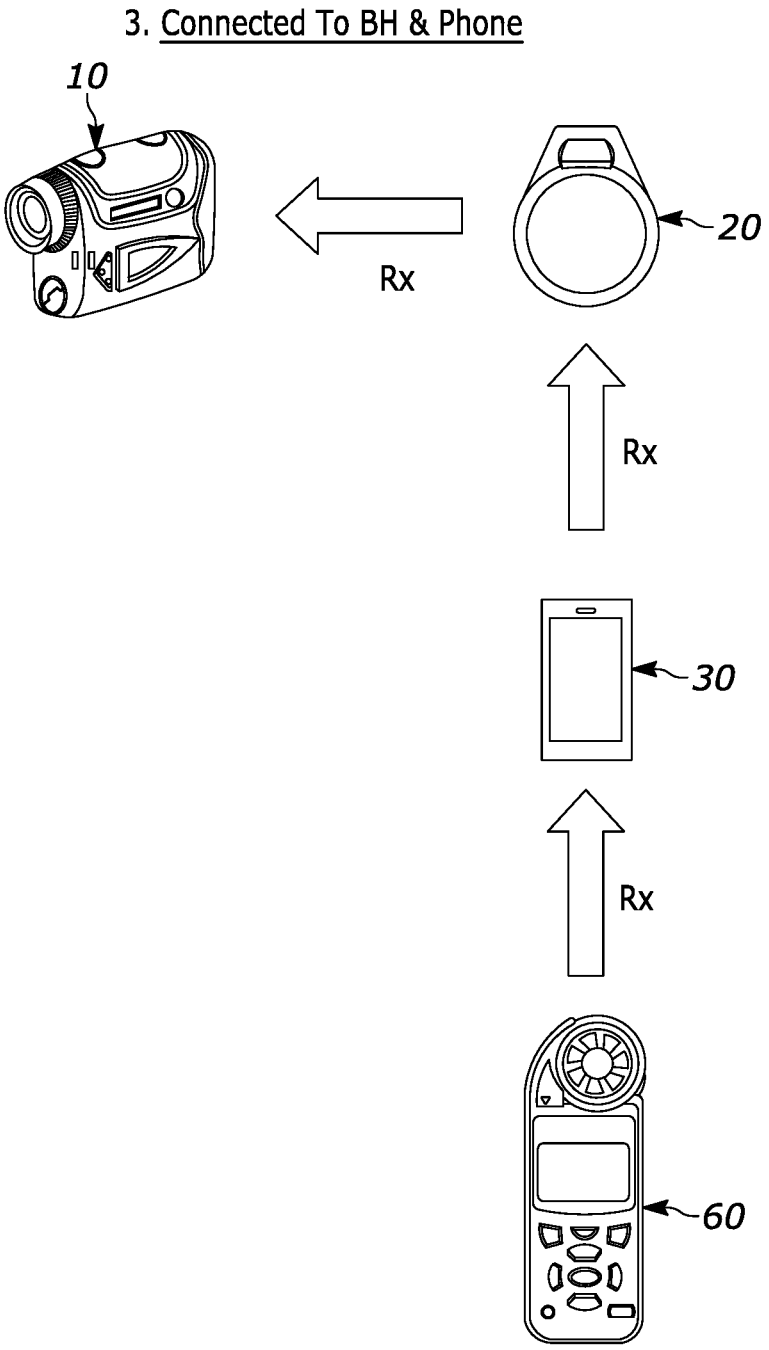
FIG. 7C is a representative depiction of a weather tracker device, such as a kestrel, configured to communicate with a mobile device. The mobile device is configured to communicate with a ballistic hub. The mobile device and/or the ballistic hub can calculate a ballistic solution, which is communicated to a laser rangefinder.

FIG. 7A is a representative depiction of a wind and weather tracker 60, such as a Kestrel, configured to communicate with a ballistic hub 20, which is configured to communicate with a laser rangefinder 10. FIG. 7B is a representative depiction of a wind and weather tracker 60, such as a Kestrel, configured to communicate with a mobile device 30, which is configured to communicate with a laser rangefinder 10. FIG. 7C is a representative depiction of a wind and weather tracker 60, such as a Kestrel, configured to communicate with a mobile device 30, which is configured to communicate with a ballistic hub 20, which is configured to communicate with a laser rangefinder 10.

In FIGS. 7A-7C, the wind and weather tracker device 60 is configured to communicate information, including but not limited to temperature, pressure, humidity, wind speed, and wind direction, to the ballistic hub 20 and/or mobile device 30. In one embodiment, the wind and weather tracker device 60 can provide a ballistic solution to the ballistic hub 20 and/or mobile device 30 if the weather tracker device is in communication with a separate device configured to calculate a ballistic solution.

The ballistic hub 20 and/or mobile device 30 is configured to communicate information to the laser rangefinder 10 including but not limited to a ballistic solution, ballistic profile, range card profile, settings, temperature, pressure, humidity, wind speed, and wind direction.

In FIG. 7C, a ballistic solution can be calculated by the mobile device 30 and communicated to the ballistic hub 20, which is communicated to the laser rangefinder 10. In another embodiment, the ballistic hub 20 can calculate a ballistic solution and communicate with the laser rangefinder 10. In yet another embodiment, both the mobile device 30 and the ballistic hub 20 can calculate a ballistic solution. In one embodiment, the mobile device 30 and the ballistic hub 20 employ the same ballistic solver. In still another embodiment, the mobile device 30 and the ballistic hub 20 employ different ballistic solvers.

In one embodiment, the mobile device 30 communicates a ballistic solution to the ballistic hub 20, which communicates the ballistic solution to the laser rangefinder 10.

Figure 8A:
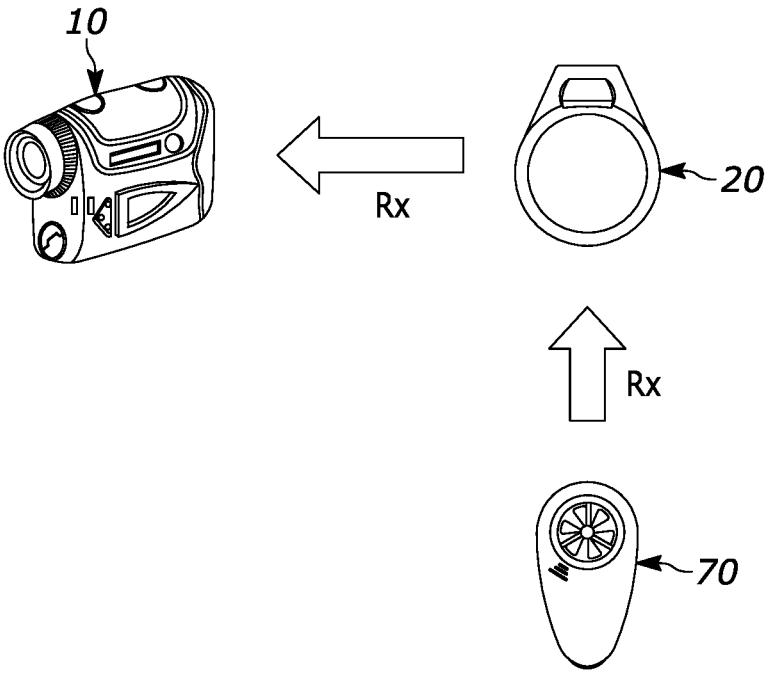
FIG. 8A is a representative depiction of a weather tracker device, such as a WeatherFlow, configured to communicate with a ballistic hub having a user selected ballistic solver to calculate a ballistic solution. The ballistic hub is configured to communicate the ballistic solution to a laser rangefinder.
Figure 8B:
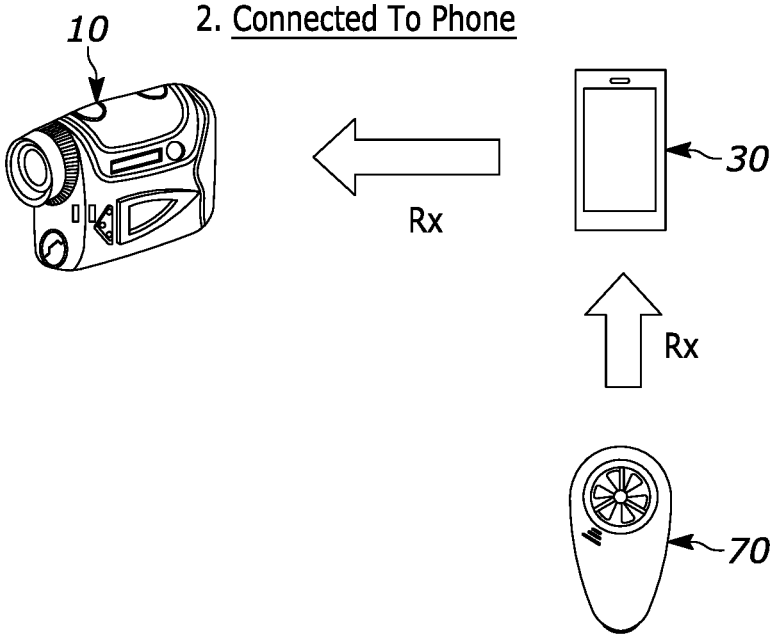
FIG. 8B is a representative depiction of a weather tracker device, such as a WeatherFlow configured to communicate with a mobile device having a ballistic solver to calculate a ballistic solution. The mobile device is configured to communicate the ballistic solution to a laser rangefinder.
Figure 8C:
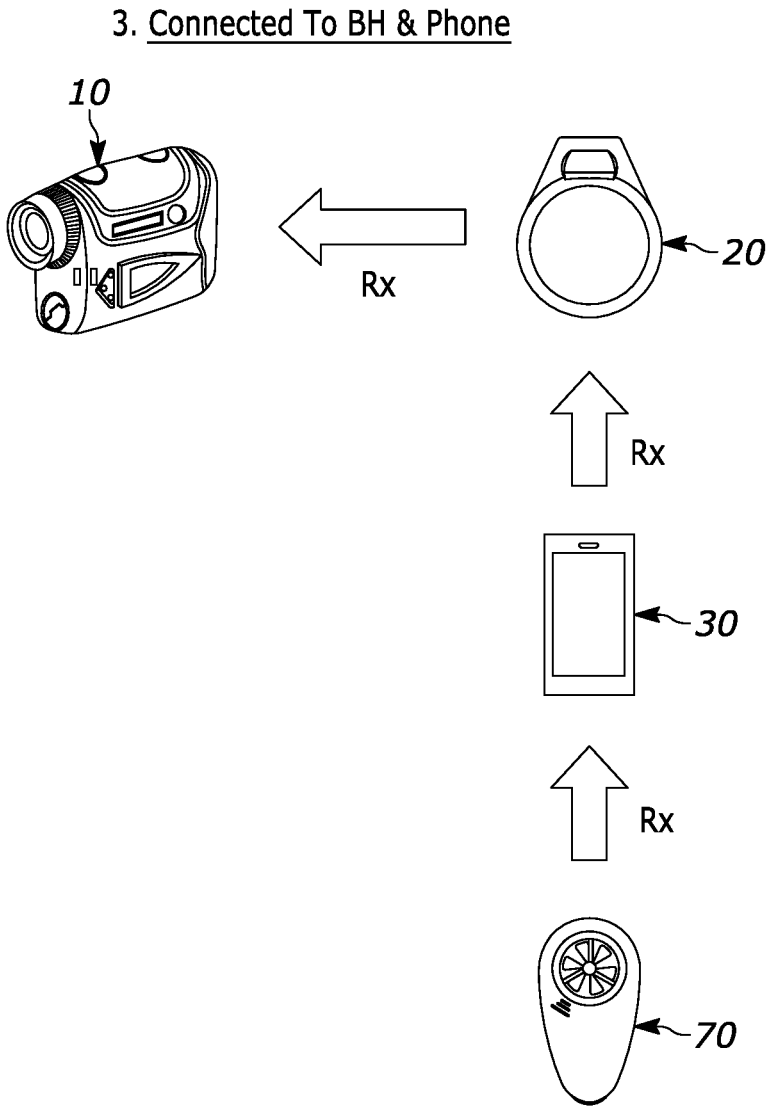
FIG. 8C is a representative depiction of a weather tracker device, such as a WeatherFlow configured to communicate with a mobile device. The mobile device is configured to communicate with a ballistic hub. The mobile device and/or the ballistic hub can calculate a ballistic solution, which is communicated to a laser rangefinder.

FIG. 8A is a representative depiction of a weather tracker device, shown as a WeatherFlow device 70, configured to communicate with a ballistic hub 20, which is configured to communicate with a laser rangefinder 10. FIG. 8B is a representative depiction of a weather tracker device, shown as a WeatherFlow device 70, configured to communicate with a mobile device 30, which is configured to communicate with a laser rangefinder 10. FIG. 8C is a representative depiction of a weather tracker device, shown as a WeatherFlow device 70, configured to communicate with a mobile device 30, which is configured to communicate with a ballistic hub 20, which is configured to communicate with a laser rangefinder 10.

In FIGS. 8A-8C, the weather tracker device 70 is configured to communicate information, including but not limited to wind speed and wind direction, to the ballistic hub 20 and/or mobile device 30. The ballistic hub 20 and or mobile device 30 is configured to communicate information to the laser rangefinder including but not limited to a ballistic solution, ballistic profile, range card profile, settings, temperature, pressure, humidity, wind speed, and wind direction.

Figure 9A:
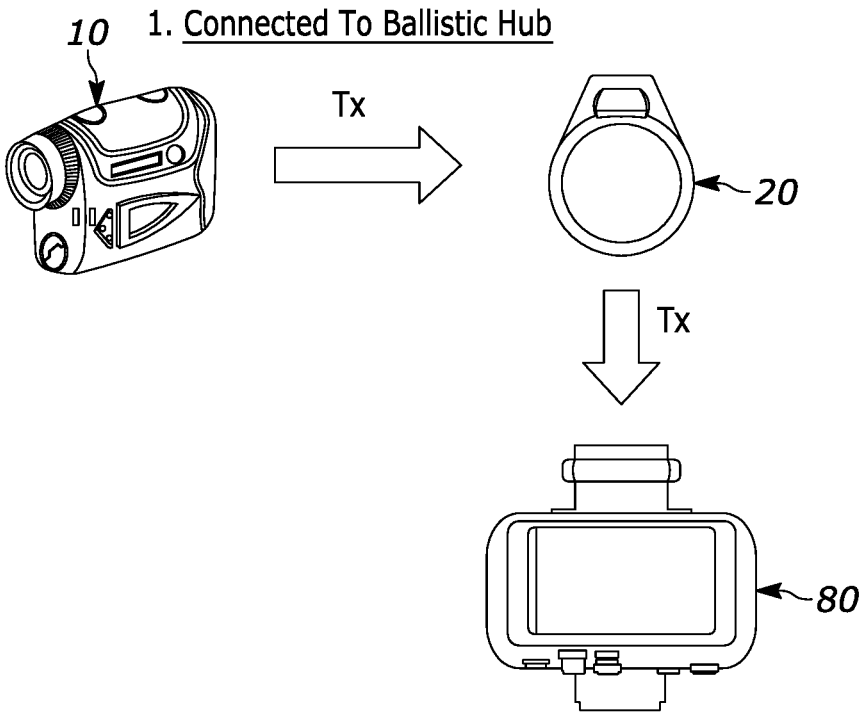
FIG. 9A is a representative depiction of a laser rangefinder configured to communicate with a ballistic hub having a user selected ballistic solver, wherein the ballistic hub is configured to communicate with a navigation system, including but not limited to a Garmin.
Figure 9B:
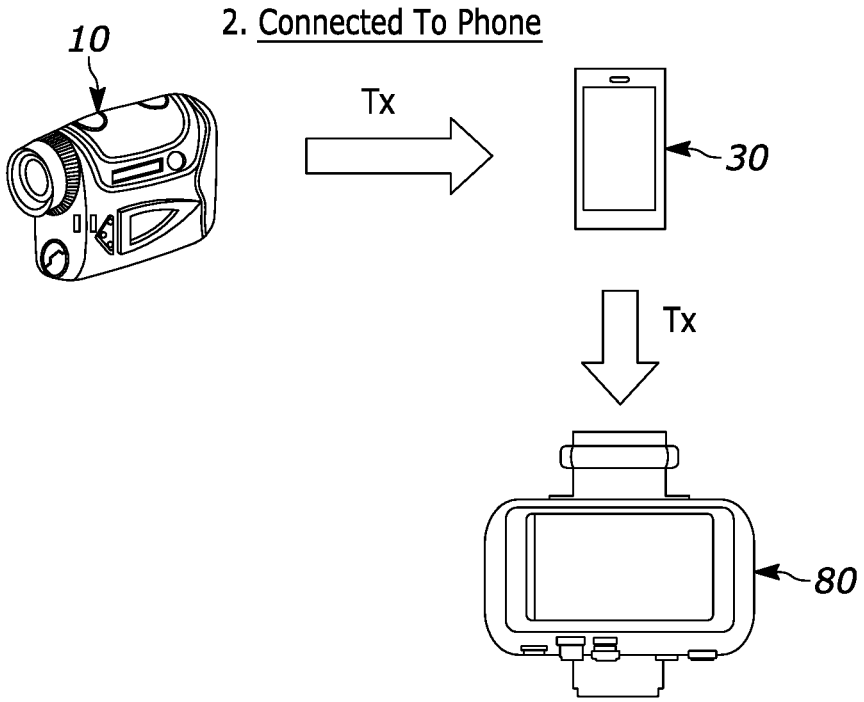
FIG. 9B is a representative depiction of a laser rangefinder configured to communicate with a mobile device having a mobile application with a ballistic solver, wherein the mobile application communicates with a navigation system, including but not limited to a Garmin.
Figure 9C:
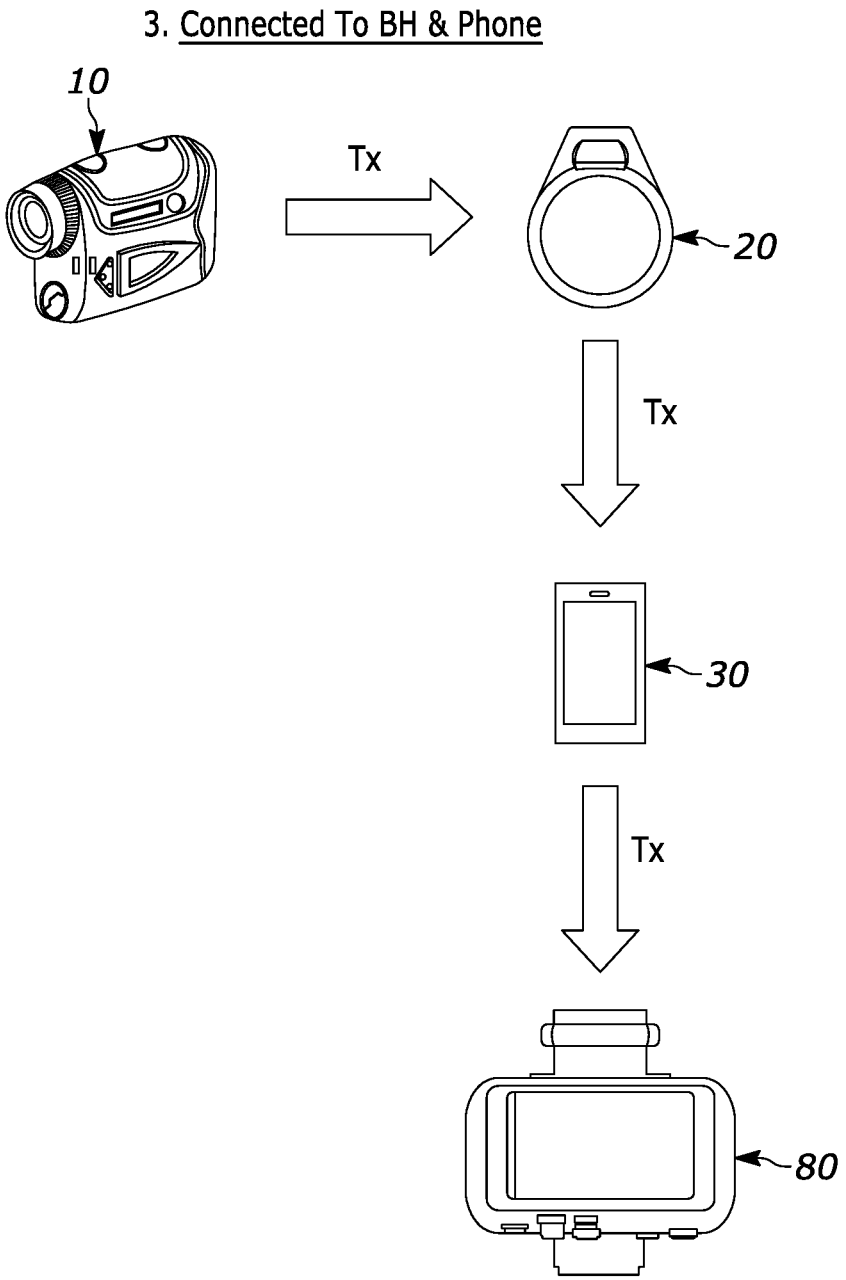
FIG. 9C is a is a representative depiction of a laser rangefinder configured to communicate with a ballistic hub having a user selected ballistic solver, which is configured to communicate with a mobile device having one or more mobile applications, wherein the mobile device communicates with a navigation system, including but not limited to a Garmin.

FIG. 9A is a representative depiction of a laser rangefinder 10 configured to communicate with a ballistic hub 20, which is configured to communicate with a navigation system 80, such as a Garmin Fortrex. FIG. 9B is a representative depiction of a laser rangefinder 10 configured to communicate with a mobile device 30, which is configured to communicate with a navigation system 80, such as a Garmin Fortrex. FIG. 9C is a representative depiction of a laser rangefinder 10 configured to communicate with a ballistic hub 20, which is configured to communicate with a mobile device 30, which is configured to communicate with a navigation system 80, such as a Garmin Fortrex.

In FIGS. 9A-9C, the laser rangefinder 10 is configured to communicate information to a ballistic hub 20 and/or mobile device 30 including but not limited to range, inclination angle, target bearing, user profile, ballistic profile, range profile settings, wind speed, and wind direction. The ballistic hub 20 provides additional data including but not limited to ballistic solution, temperature, pressure, and humidity. The ballistic hub 20 is configured to communicate information to the navigation system 80 including but not limited to range from the laser rangefinder, inclination angle from the laser rangefinder, target bearing from the laser rangefinder, and range profile.

Figure 10:
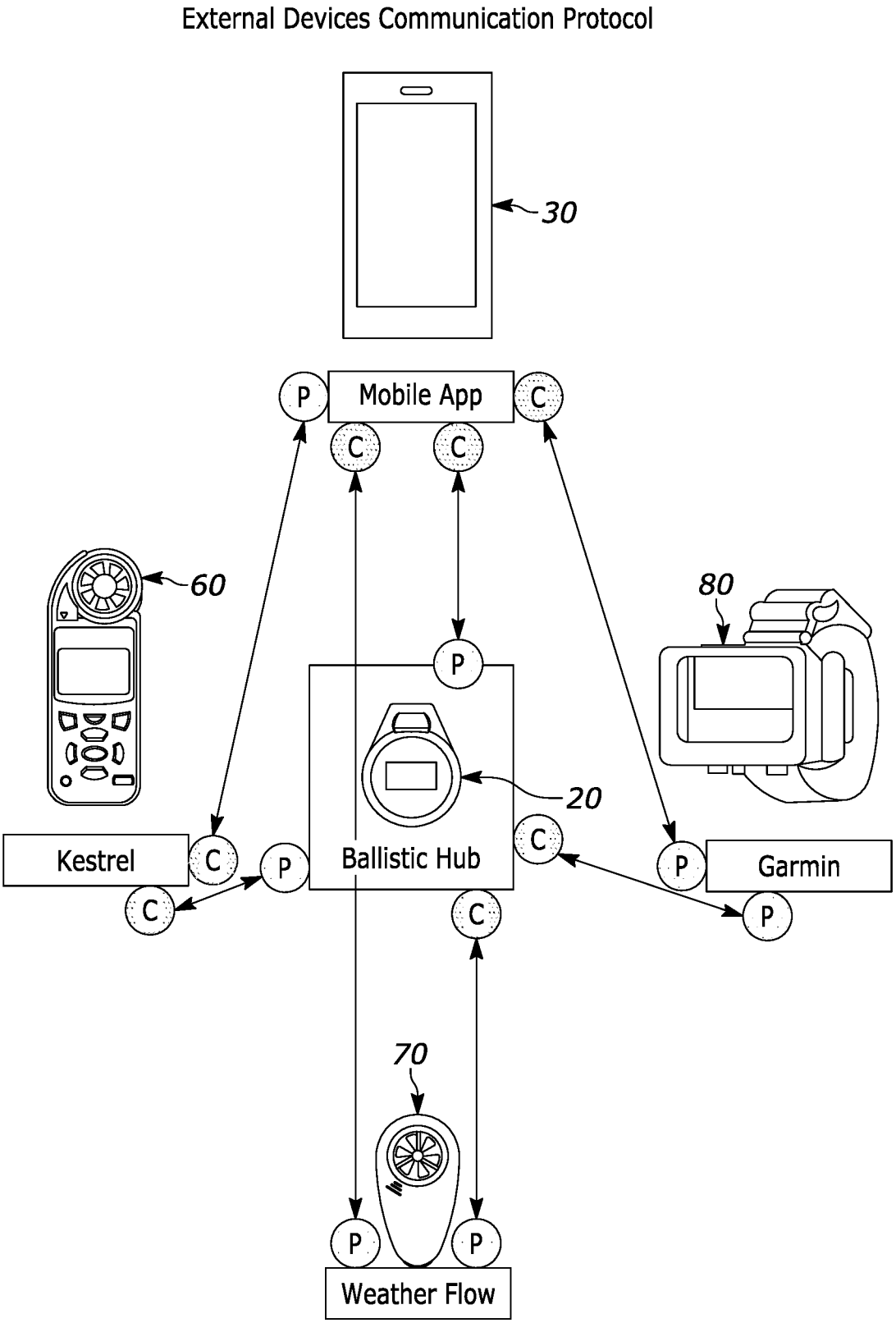
FIG. 10 is a representative depiction of external device communication. A ballistic hub is configured to communicate with multiple devices, being configured to receive, process, and send information. The ballistic hub can be configured to communicate with a mobile device, a weather tracker device, and a navigation device.

FIG. 10 is a representative, non-limiting depiction of a ballistics hub 20 configured to communicate with one or more external devices. The ballistic hub can communicate with any number of devices including but not limited to 1, 2, 3, 4, 5, 6, 7, 8, 9, 10, and more than 10 devices. The mobile device 30 is used to manage and select settings of one or more external devices. The mobile device 30 and ballistic hub 20 are used to manage the connections between external devices and authorize communication between one or more devices. The ballistic hub 20 is a central point of communication with one or more devices when the mobile device 30 is not present or is unable to secure a connection to one or more external devices.

As shown in FIG. 10, a network of connections is possible using a ballistic hub 20 as described herein. The ballistic hub 20 is configured to communicate with a mobile device 30, a weather tracking device, shown as a kestrel 60, a second weather tracking device, shown as a WeatherFlow 70, and a navigation device, shown as a Garmin 80. The ballistic hub 20 can receive information from a first device, process the received information, and communicate with a second device.

By way of non-limiting example, a WeatherFlow 70 is configured to provide information to the ballistic hub 20. The ballistic hub 20 processes the received WeatherFlow information and provides new information to a Kestrel 60. The kestrel 60 is also configured to communicate information to the ballistic hub 20, which will receive and process the kestrel information. The ballistic hub 20 can communicate the processed kestrel information to a Garmin 80. Likewise, the Garmin 80 is configured to convey information to the ballistic hub 20.

The ballistic hub is configured to send and receive information. In one embodiment, the ballistic hub can receive information from a first device, process the received information, and send new information back to the first device.

In another embodiment, the ballistic hub can received information from a first device and send the information to a second device. In still another embodiment, the ballistic hub can receive information from a first device, process the received information, and send the processed information to a second device.

Figure 11:
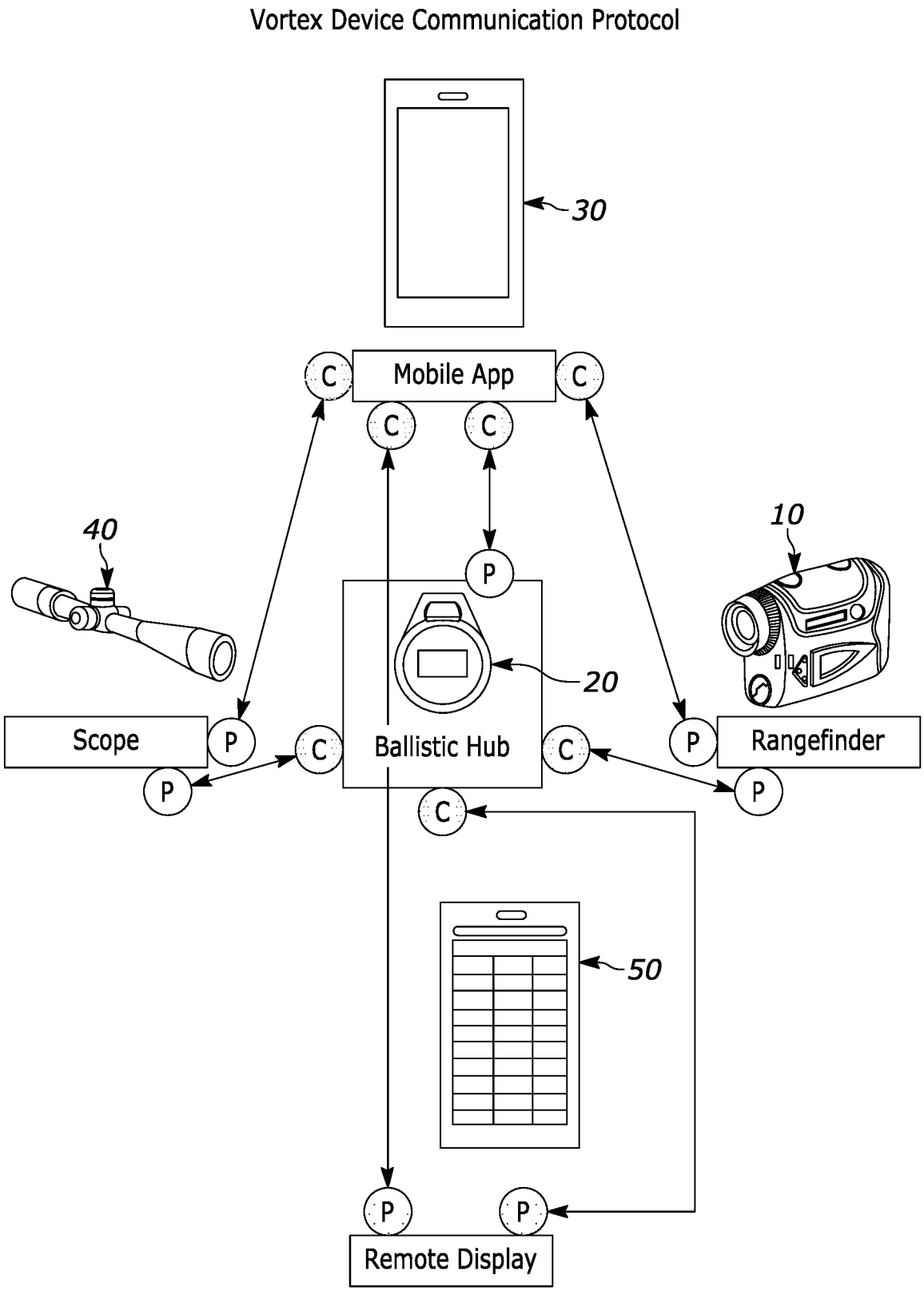
FIG. 11 is a representative depiction of a ballistic hub configured to communicate with mobile device having a mobile application, a laser rangefinder, a viewing optic and one or more external devices. Information is conveyed between a laser rangefinder, a viewing optic and one or more external devices through the ballistic hub and/or mobile device.

FIG. 11 is a representative, non-limiting depiction of a ballistics hub 20 configured to communicate with a viewing optic 40 and a laser rangefinder 10. A mobile device 30 with a mobile application can be used to determine the settings and configurations of one or more connected devices. The user can use the mobile device 30 having a mobile application to select a ballistic solver. The mobile device 30 is configured to communicate the ballistic solver to the ballistic hub 20.

A ballistic hub 20 and a mobile device 30 can be used to manage the one or more connected devices and allow connected devices to communicate. The ballistic hub 20 is the central device when the mobile device is not present and is configured to manage the one or more connected devices based on the last set-up or configurations for that device as provided by the mobile application of the mobile device.

As shown in FIG. 11, the ballistic hub 20 is configured to receive information from a laser rangefinder 10, including but not limited to distance to a target. The ballistic hub 20 can process the received distance from the laser rangefinder 10, and provide a ballistic solution to a riflescope 40. The ballistic hub 20 is also configured to receive and process information from a remote display 50, which is also configured to receive information from the ballistic hub 20.

Information is conveyed between a laser rangefinder, a viewing optic and one or more external devices through the ballistic hub and/or mobile device. In one embodiment, the laser rangefinder and the viewing optic do not directly communicate to one another. Rather, the laser rangefinder is configured to provide information to the ballistic hub and/or mobile device, which then communicates information to a viewing optic. The ballistic hub and/or mobile device may communicate information as it is received by the ballistic hub and/or mobile device or the information can be first processed by the ballistic hub and/or mobile device and then conveyed to the viewing optic.

Mobile Device/Ballistic Hub

In one embodiment, the ballistic hub includes a ballistic solver. In one embodiment, the ballistic hub includes a user selected ballistic solver. In one embodiment, the mobile device having a mobile application includes a ballistic solver. In one embodiment, the ballistic hub and/or the mobile device will include the additional functionality of: ballistic solver, temperature, pressure, humidity, user profiles, and range card profile.

In one embodiment, the mobile application on the mobile device will be the primary mode for data entry, user setup, and device management and will include the functionality of device pairing; device settings; selection of firearm settings; selection of bullet settings and libraries; selection of drag models; selection and management of user profiles (saved firearm, bullet and drag model profile); viewing of device environmental sensors and wind bearing capture; compass calibration; single and multiple ballistic display; selection and management of range card profiles; and target parameters.

In one embodiment, the ballistic hub and/or mobile device will use the range data and user profiles to compute a ballistics solution based upon the readings from onboard environmental sensors in the ballistic hub, or external windmeter sensors, or environmental data obtained from the mobile device or weather tracker devices.

In one embodiment, the ballistic hub is housed in a fob. In one embodiment, the fob is compact in size, air-tight and water tight. The fob can be easily affixed to a chain, a key chain, a firearm, a belt, a backpack, a shoe, a hat, a shirt, pants or any other readily available apparatus.

In one embodiment, the fob with the ballistic hub can be used with multiple firearms and multiple viewing optic. The fob provides a convenient method to use a ballistic solver with multiple firearms and viewing optics.

In one embodiment, the fob has a height of 5 inches or less. In another embodiment, the fob has a height of four inches or less. In another embodiment, the fob has a height of 3 inches or less. In another embodiment, the fob has a height of 2 inches or less. In another embodiment, the fob has a height of 1.5 inches or less. In one embodiment, the fob has a height from 1.2 to 2.2 inches. In still another embodiment, the fob has a height of from 1.6 inches to 3 inches.

In one embodiment, the fob has a width of 5 inches of less. In one embodiment, the fob has a width of 4 inches of less. In one embodiment, the fob has a width of 3 inches of less. In one embodiment, the fob has a width of 2 inches of less. In one embodiment, the fob has a width of 1.5 inches of less. In one embodiment, the fob has a width from 0.8 to 3.2 inches. In one embodiment, the fob has a width from 1.2 to 2.5 inches. In one embodiment, the fob has a width from 1.3 to 2.2 inches.

In one embodiment, the fob has a depth of 1 inch of less. In one embodiment, the fob has a depth of 0.5 inch of less. In one embodiment, the fob has a depth of 0.4 inch of less. In one embodiment, the fob has a depth of 0.3 inch of less. In one embodiment, the fob has a depth of 0.2 inch of less. In one embodiment, the fob has a depth from 1 to 2 inches. In one embodiment, the fob has a depth from 0.4 to 1.3 inches. In one embodiment, the fob has a depth from 0.2 to 0.8 inches.

In one embodiment, the mobile device having a mobile application includes setup and manage Profiles; and send profiles and data to devices, such as a range finder and a viewing optic.

Laser Rangefinder

In one embodiment, when connected to a mobile phone application and/or the ballistic hub via Bluetooth technology, the laser rangefinder will have the ability to send and receive data. The laser rangefinder will be able to send the following data: shot angle; shot bearing; range to target; wind mode; wind speed; wind direction; settings; user profile; and range profile.

In one embodiment, the laser rangefinder will be configured to receive the following data: ballistics solution; user profile (gun, bullet, and curve); range profile; wind speed; wind direction; temperature data; pressure data; relative humidity data; and settings.

In one embodiment, the range finder can have a 905 nm laser rangefinder module with electronics, display, and Bluetooth communication capabilities. In one embodiment, the laser rangefinder can have a communication protocol that will allow the rangefinder bi-directional communicate with one or more connected devices, ballistic hub, and mobile device and standard industry devices (Kestrel, Weatherflow, Garmin). In one embodiment, the range finder will incorporate Bluetooth technology (BLE 652 Nordic NRF 52 chipset) for communication to external devices.

In one embodiment, the laser rangefinder will have ranging performance to meet the needs of long-range shooting, with the ability to range up to 5000 yards, 2500 yards on trees, and 2000 yards on deer.

In one embodiment, the rangefinder module will have dimension targets of 45 mm-48 mm wide, 20 mm-22 mm tall, and 50 mm-55 mm long. In one embodiment, the rangefinder module will not exceed 4 ounces.

In one embodiment, the laser rangefinder will have a class I, 635 nm red integrated visible alignment laser. The laser will be utilized by the user to insure co-alignment (zeroing) of rangefinder to the rifle. Need ability to see the laser to a 100 yards with a minimum of 50 yards.

In another embodiment, the laser rangefinder will have a 1.3-inch OLED display that can rotate the displayed information based upon mounted orientation.

In one embodiment, the laser rangefinder will communication with the ballistic hub or mobile device. The range finder will send device data (range, profiles, wind, etc.) to the ballistic hub/mobile phone. The ballistic hub/mobile phone will provide additional data (temperature, pressure, etc.) and calculate a ballistic solution based on the rangefinder data. The ballistic solutions will be sent back to the rangefinder and be viewable in the rangefinder display along with rangefinder data.

In one embodiment, the laser rangefinder will have a wind bearing capture algorithm.

In one embodiment, the laser rangefinder will have single and multiple measurement modes. With BALLISTICS mode OFF, the SINGLE measurement modes will calculate and display a single RANGE. The MUTIPLE mode (range card) will allow the user to range, display and store multiple distances. With the BALLISTIC mode ON, both measurement modes will send range data to the Ballistic Hub/mobile device where a ballistic solution will be calculated utilizing a stored user profile (bullet & rifle profile). Once the ballistic solution is calculated, the data will be sent back to the rangefinder and the range finder will display the RANGE, VERTICLE, and HORIZONTAL hold calculations. In the MULTIPLE measure mode, the user can acquire and store up to 10 targets in sequence. Each measurement will have the RANGE, VERTICLE, and HORIZONTAL hold calculations (transmitted from ballistic solver of the ballistic hub or mobile device) displayed.

In one embodiment, the laser rangefinder has an integrated operation button on the rangefinder housing. This is a 5-button operation pad that will allow the user to navigate through the ranger finder menus and settings.

In one embodiment, the laser rangefinder has a remote operation button that affixes to a firearm. The button will be tethered to the RANGEFINDER and can be affixed to a point on the rifle defined by the user. The buttons will allow a user to remotely control ranging single or multiple targets, scrolling and selecting through the digital range card.

Communication Component

In one embodiment, the ballistic hub will communicate with one or more devices through BLE (Bluetooth) 4.0 or greater communication. BLE will be the standard communication between firearm devices, other industry devices and meters, and the mobile device.

Firearm Devices

In one embodiment, one or more firearm devices can communicate with the ballistic hub. Firearm devices include but are not limited to rangefinders, scopes, binoculars, monoculars, spotting scopes, and digital dope/range cards. A fob housing the ballistic hub can be used interchangeably between one or more firearm devices.

Industry Standard Devices

Industry standard devices include but are not limited to Kestrel Weather Meter; WeatherFlow Meters; and Garmin Fortrex 701. To achieve ease of use, efficacy and integration with other equipment, the ballistic hub/mobile device can connect a weather station (for example, Kestrel, or ultrasonic wind direction and velocity detector), a GPS (for example, Garmin), a night vision module, a thermal unit (for example, FUR) a rangefinder, and/or a video inter-link. Each component may be linked directly to a PDA, computer, telephone, or other device by hardwire, IR, Bluetooth, microwave, manual input, and the like.

Device Architecture

In one embodiment, device architecture will need to support a standardized communication protocol. The rangefinder will communicate with a ballistic hub, mobile device, other devices, and external industry devices (windmeters, etc.). As such, a common communication protocol will ensure a supportable platform. Providing a common set of device outputs/inputs that can be consumed by other devices and a mobile device having a mobile application will be helpful.

For example, common outputs for data would include: range to target; user Profile (rifle, bullet, curve data); range profile (stored range card); ballistics solution; shot angle; shot bearing; wind mode; wind speed; wind direction; pressure data; temperature data; and relative humidity data.

Example of common inputs for data include: user Profile (gun, bullet, and curve); range Profile; wind speed; wind direction; sleep time delay; ballistics solution; temperature data; pressure data; and relative humidity data.

Device Memory and Storage Requirements

In one embodiment, the rangefinder has sufficient processing power and memory to support Bluetooth communication, as well as the importing and exporting of data. This includes the ability to store user profiles and range profiles. The device will need to support the capability of importing and displaying ballistic solutions from the ballistic hub or the mobile device.

Anemometer Integration

In one embodiment, when connected to an anemometer device via Bluetooth technology, the rangefinder will have the ability to send and receive data. The rangefinder will be able to send the following data to an anemometer device: Shot Angle; Shot Bearing; and Range to target.

In one embodiment, the rangefinder will be able to receive the following data from an anemometer: Wind Speed; Wind Direction; Temperature Data; Pressure Data; and Relative Humidity Data.

Garmin Integration

In one embodiment, when connected to a Garmin Foretrex 701 device via Bluetooth technology, the rangefinder will have the ability to send data. The rangefinder will be able to send the following data to a Garmin Foretrex 701 device: shot angle; shot bearing; range to target; range profile; temperature data; pressure data; and relative humidity data.

Representative System Operation

One representative, non-limiting example of a system operation is now described. From an OFF state, pressing the MEASURE button will turn the system ON. The firearm mounted rangefinder will have two primary modes of operation: Range Mode (RANGE) and Ballistics Mode (BAL). The mode will be selected through the menu.

If in BAL mode, the rangefinder will export range data to the Ballistic Hub or the mobile device having a mobile application. The rangefinder will import and display ballistic solutions from the ballistic hub and/or the mobile device having a mobile application. This is accomplished via access to the ballistics solver, environmental sensors, weapon profiles and range profiles resident in the ballistic hub and/or mobile device having a mobile application.

If in RANGE mode, ballistic computation is disabled.

Pressing and releasing the MEASURE button will provide a single range. Double clicking the MEASURE button will activate SCAN mode, which will continuously range the target and display the updated range on screen; once the MEASURE button is pressed again, the last range will be displayed.

Once a ballistics solution has been determined and returned, pressing and releasing the UP or DOWN buttons will cycle through four values: the captured temperature, pressure, heading, and wind associated with the solution. Pressing and releasing the LEFT or RIGHT buttons will decrease or increase the wind value by one unit and the system will compute a new ballistics solution. If the LEFT and RIGHT buttons are pressed at the same time it will make the wind speed equal to zero.

The user will have the ability to select one of two display modes, a single (SNG) measurement mode and a multi-measurement (MLT) mode.

Single measure mode (SNG) allows the user to range a single target. If in BAL mode, the RANGE, VERTICLE, and HORIZONTAL hold calculations from the ballistic hub and/or mobile device having a mobile applications will be displayed alongside the range data.

Multi-measurement mode (MLT) allows the user to acquire and store up to 10 targets in sequence. In this mode, the user views a list of target RANGES stored, and if in BAL mode, the accompanying VERTICLE and HORIZONTAL hold data. Measuring a target displays single RANGE data. If the user wishes to add this to the range list, the RIGHT arrow is depressed. Range data is sent to the ballistic hub and/or mobile device and the BALLISTIC CORRECTIONS are returned to the rangefinder. If the range was not captured correctly, the user can re-range the target without the previous data being added to the range list. If the user wishes to not add a range to the range list, the LEFT arrow will return to the range list screen. Upon returning to the range list the user will be prompted to SAVE the range list with a YES or NO prompt. The user can utilize UP and DOWN arrows to select YES or NO. If YES is selected the user will be prompted to enter a RANGE CARD PROFILE title. Once in the range list screen, the user can utilize the UP and DOWN arrows to highlight a range in the list. The RIGHT arrow highlights the top range in the displayed list allowing the UP and DOWN to reposition the selected entry in the range card. Pressing the MEASURE button saves the highlighted range in the selected position. Pressing the LEFT prompted to SAVE the range list with a YES or NO prompt. The user can utilize UP and DOWN arrows to select YES or NO. If YES is selected the user will be prompted to enter a RANGE CARD PROFILE title. The stored data consists of range, inclination, bearing, horizontal and vertical corrections. RANGE CARD PROFILES can be transmitted to ballistic hub, mobile device or any connected device. With the mobile device, the user can save the range card data as a RANGE CARD profile. RANGE CARD profiles can be uploaded from the ballistic hub and/or mobile device to any applicable devices.

When the RANGEFINDER is Bluetooth enabled, it can be connected to the ballistic hub, a smartphone with mobile applications, other devices, or other Bluetooth enabled devices. If the RANGEFINDER is connected to a display unit, the RANGEFINDER will send a complete ballistic solution to the display for showing to the user. The printed circuit board assembly should include the ability to allow a re-flash of the microcontroller to occur over the Bluetooth module. Likewise, the Bluetooth module firmware should be able to be updated a well.

Pressing and holding for 5 seconds the MEASURE button will access the menu. Using the ARROW and ENTER buttons allows the user to navigate and select settings.

The OPERATIONS Menu settings includes but is not limited to:

a. Ranging Mode include RANGE (No ballistics) and BAL (Ballistics)
b. Measure Mode includes SINGLE and MULTIPLE
c. Wind Capture Mode includes FCW (Full Cross Wind) and WBC (Wind Bearing Capture)
d. Weapon Profile would include storage and input for one or more firearm profiles.
e. Range Profile would include storage and input for one or more range profiles.

The SETUP Menu settings include but are not limited to display brightness, target mode, units, such as English in yards, Fahrenheit, in Hg, Miles Per Hour, and Metric in Meters, Celsius, millibar, Meters Per Second and compass.

The CONNECTIONS Menu settings includes import data (off; Kestrel; Weatherflow); export data (off, Kestrel and Garmin).

The menu allows the user to see all the Connected Devices (BALLISTIC HUB, SCOPE, BINOCULAR, DIGITAL RANGE CARD, SPOTTING SCOPE, PHONE, KESTREL, WEATHERFLOW, GARMIN FORTREX) This menu will also allow the user to DISCONNECT a device if desired or needed.

The menu also allows the user to see prior connected devices. The DEVICES IN MEMORY category displays all of the device connection history and devices that are recognized by Bluetooth but not connected. All the devices in this list are not currently connected. This menu allows a user to CONNECT and DISCONNECTED device.

Wind Speed Adjustment in Ballistics Mode

There will be two wind modes that are selectable by the user, Full Cross Wind (FCW) and Wind Bearing Capture (WBC).

FCW mode is the default mode and while in this wind mode the LEFT and RIGHT buttons are used to increase/decrease the wind speed in 1 mph or m/s increments with a corresponding arrow displayed. For example, if the LEFT button is pressed twice it will increase the wind speed by 2 units and a corresponding left arrow will be displayed. Then, if the RIGHT button is pressed once it will decrease the wind by 1 unit and the LEFT arrow will remain displayed. If the LEFT and RIGHT buttons are pressed while in FC mode all wind bearing values will be treated as if they were either coming from 90 degrees or 270 degrees relative to the user. If the RANGEFINDER times out the unit will remain in FC mode and retain the last wind speed and direction input by the user. While in FC mode, if the LEFT and RIGHT buttons are pressed simultaneously the wind speed will be zeroed and the unit will blink the new zero value 3 times.

Users enter the Wind Bearing Capture mode by selection through the operations menu. In WBC mode, the solver will formulate all ballistics calculations using the captured wind bearing relative to the firing direction. Upon return to the main display, the wind bearing (direction) and wind direction arrows will flash three times. When in WBC mode, the left/right wind direction arrows are both illuminated to indicate that wind bearing capture mode is active. Wind velocity is updated one unit at a time by pressing the LEFT and RIGHT buttons. The LEFT and RIGHT buttons will not change the direction of the wind. The wind bearing will display - - - ° until a bearing is entered, at which time the bearing (0-360°) will be displayed. To capture the wind bearing, point the unit into the wind and press the WIND button. If the user wants to capture a different bearing, point the rangefinder into the direction of the wind and press the WIND button again. This will replace the previous captured wind bearing with the newly captured bearing. If the RANGEFINDER times out, the unit will remain in WBC mode and retain the last bearing captured and speed.

The systems, devices, and methods disclosed herein are further described by the following paragraphs:

1. A device comprising one or more ballistic calculators for providing a ballistic solution and configured to communicate with a separate and distinct range finder.

2. A device comprising one or more ballistic calculators for providing a ballistic solution, one or more environmental sensors and configured to communicate with a range finder, wherein the device is not integrated into the range finder, a firearm or a viewing optic.

3. A device comprising one or more ballistic calculators for providing a ballistic solution, and a processor/control module configured to communicate with a mobile device and a range finder, wherein the device is not integrated into the range finder, a firearm or a viewing optic.

4. A device comprising software for a ballistic calculator for providing a ballistic solution, and a processor/control module configured to communicate with a mobile device and a range finder, wherein a user selects the software for the ballistic calculator through the mobile device.

5. A system comprising a range finder configured to determine the distance to a target, a ballistics hub having one or more ballistics calculators for determining a ballistic solution using the distance provided by the range finder, and a viewing optic having a processor configured to receive the ballistic solution from the ballistic hub and a display for displaying the ballistic solution.

6. A system comprising a range finder configured to determine the distance to a target, a ballistics hub having a ballistics calculator for determining a ballistic solution using the distance provided by the range finder, and a processor configured to communicate the ballistic solution to the range finder.

7. A system comprising a range finder configured to determine the distance to a target, a ballistics hub having a chosen ballistic calculator for determining a ballistic solution using the distance provided by the range finder, and a mobile device configured to communicate the chosen ballistic calculator to the ballistic hub.

8. The device of any of the preceding claims, wherein the device is not integrated in a range finder, firearm or viewing optic.

9. The device of any of the preceding claims, wherein the device can clip to a range finder, a firearm or a viewing optic.

It is specifically intended that the disclosure not be limited to the embodiments and illustrations contained herein, but include modified forms of those embodiments including portions of the embodiments and combinations of elements of different embodiments as come within the scope of the following claims.

What is claimed is:

1. A system comprising: a mobile device having a mobile application with a ballistic solver and configured to communicate the ballistic solver to a ballistic hub, the ballistic hub configured to store and operate the ballistic solver and receive a range from a rangefinder, wherein the ballistic hub calculates a ballistic solution using the ballistic solver in the absence of internet or cellular connectivity, and wherein the ballistic hub is housed in a fob, and further wherein the ballistic hub is not a component of the rangefinder.

2. The system of claim 1, further comprising a weather tracker device configured to send and receive information to and from the ballistic hub.

3. The system of claim 1, further comprising a navigation device configured to send and receive information to and from the ballistic hub.

4. The system of claim 1, further comprising a viewing optic configured to send and receive information to and from the ballistic hub.

5. The system of claim 4, wherein the ballistic hub is configured to communicate the ballistic solution to the viewing optic.

6. The system of claim 1, wherein the mobile device is configured to communicate user setup information to the ballistic hub.

7. The system of claim 6, wherein user setup information is selected from the group consisting of: device pairing; device settings; selection of firearm settings; selection of bullet settings; selection of drag models; selection and management of user profiles; environmental sensors; wind bearing capture; compass calibration; single and multiple ballistic display; selection and management of range card profiles; and target parameters.

8. The system of claim 1, wherein the ballistic hub further comprises sensors for at least one of temperature, pressure; and humidity.

9. The system of claim 1, wherein the ballistic hub is configured to communicate the ballistic solution to the rangefinder without using internet or cellular connectivity.

10. The system of claim 1, wherein the ballistic hub and the rangefinder communicate through Bluetooth communication.

11. A fob comprising: a ballistic hub configured to receive a range from a laser rangefinder and calculate a ballistic solution, wherein the ballistic hub is not a component of the rangefinder.

12. The fob of claim 11, wherein the ballistic hub and the rangefinder communicate through Bluetooth communication.

13. The fob of claim 11, wherein the ballistic hub is configured to communicate the ballistic solution to the rangefinder without using internet or cellular connectivity.

14. The fob of claim 11 wherein the ballistic hub is configured to communicate with a weather tracker device.

15. The fob of claim 11, wherein the ballistic hub is configured to communicate with a viewing optic.

16. The fob of claim 11, wherein the ballistic hub is configured to communicate with a navigation system.

17. The fob of claim 11, wherein the ballistic hub is configured to receive a ballistic solver from a mobile device.

18. A fob comprising: a ballistic hub configured to receive a range from a rangefinder and having a ballistic solver to calculate a ballistic solution, wherein the fob has a height of 3 inches or less, a width of 3 inches or less and depth of 1 inch or less, wherein the ballistic hub is not a component of the rangefinder.

* * * * *